United States Patent [19]

Grollimund et al.

[11] Patent Number: 4,934,624

[45] Date of Patent: Jun. 19, 1990

[54] A ROBOTIC HAND

[75] Inventors: Everett C. Grollimund, Midlothian; Donald L. Brookman; Steven F. Spiers, both of Richmond, all of Va.

[73] Assignee: Philip Morris, Inc., New York, N.Y.

[21] Appl. No.: 307,002

[22] Filed: Feb. 6, 1989

Related U.S. Application Data

[62] Division of Ser. No. 820,665, Jan. 21, 1986, Pat. No. 4,821,972.

[51] Int. Cl.[5] ..... B65H 19/10; B66C 1/00; B25J 11/00

[52] U.S. Cl. ..... 242/72.1; 414/736; 414/911

[58] Field of Search ..... 242/58.4, 78.8, 72 R, 242/72.1, 67.3 R; 901/6; 414/736, 744 A, 751, 776, 908, 911; 279/2 R, 2 A

[56] References Cited

U.S. PATENT DOCUMENTS 4,062,455 12/1977 Flatau ..... 414/735

4,626,013 12/1986 Barrows ..... 414/736 X 4,708,574 11/1987 Conboy et al. ..... 414/626 X

*Primary Examiner*—David Werner

*Attorney, Agent, or Firm*—Wayne M. Kennard

[57] ABSTRACT

A robotic hand has two sections disposed 90 degrees apart. One section has a bobbin core-engaging device for the purpose of lifting and handling the bobbin. This section also has a bobbin transfer means for removing the bobbin from the bobbin core engaging device. The second section of the robotic hand has a first fixed finger and a second movable finger. The fingers are used for clamping at least one lamination thickness of paper from the bobbin therebetween and holding it while the robotic hand is indexed to thread a processing machine with the paper from the bobbin. The second section also has a bobbin core removing means formed by the first fixed finger and a movable third finger. The first and third fingers cooperate for engaging the bobbin core and removing it from the machine after all of the paper has been removed therefrom.

14 Claims, 11 Drawing Sheets

A ROBOTIC HAND

This is a division of application Ser. No. 820,665, filed Jan. 21, 1986, entitled SYSTEM AND METHOD FOR USE IN HANDLING AND DELAMINATING BOBBINS OF PAPER MATERIAL, now U.S. Pat. No. 4,821,972.

TECHNICAL FIELD

The present invention relates to a system and method for use in handling and delaminating bobbins of material such as film or paper. The present invention, more specifically, relates to a system and method for handling and delaminating a bobbin of tipping paper, or the like, for use in the production of tobacco products having means for removing the bobbin of tipping paper from a place of storage, mounting the bobbin of tipping paper on a desired machine, delaminating the possibly damaged outer laminations of tipping paper of the bobbin, threading the desired machine with tipping paper from the bobbin after delamination and removing the bobbin core from the machine after all of the tipping paper has been removed therefrom prior to placing a new bobbin of tipping paper on the desired machine.

BACKGROUND ART

Tipping paper is paper applied about the filter and a portion of a cigarette body to attach the filter to the cigarette body. Typically, tipping paper, once made, is stored in bobbins. These bobbins generally comprise a bobbin core upon which the tipping paper is wound, and such bobbins are generally shipped to cigarette manufacturers for the production of cigarettes. In many cases the outer laminations of tipping paper of the bobbin are damaged during shipping and handling and must be removed before the tipping paper of the bobbin can be fed into, for example, a laser perforator machine, used to process the tipping paper.

The method previously used to remove possibly damaged outer laminations consisted of manually disposing the bobbin on a processing machine, and then manually removing any damaged outer laminations until a place in the bobbin is reached where the tipping paper is no longer damaged. The tipping paper is then cut, and the undamaged tipping paper is manually threaded in the machine for processing. After all of the tipping paper of the bobbin is processed by the machine, the bobbin core is manually removed from the machine.

This previous method of handling and delaminating bobbins of tipping paper is time-consuming and inefficient.

The present invention overcomes these problems and provides an automatic or semi-automatic system and method which no longer requires manual removal of the bobbin from a place of storage, manual mounting of the bobbin of tipping paper on a machine, manual delamination of a bobbin of tipping paper and manual removal of the bobbin core from the machine after all of the tipping paper has been removed therefrom prior to placing a new bobbin of tipping paper on the machine.

DISCLOSURE OF INVENTION

The present invention is a system and method for removing a bobbin of tipping paper from a place of storage, mounting the bobbin of tipping paper on a desired machine, delaminating possibly damaged outer laminations of tipping paper prior to the tipping paper being processed by the machine and removing the bobbin core from the machine after all of the tipping paper has been removed therefrom so a new bobbin can be placed on the machine for processing.

The system of the present invention comprises a conventional robotic arm having a novel robotic hand rotatably attached to the distal end of the robotic arm, a delaminator apparatus, and a control console for controlling the operations of the robotic arm, robotic hand and the delaminator apparatus.

The robotic arm with a robotic hand connected to its distal end is used in conjunction with the delaminator apparatus for carrying out the method of the system of the invention. The robotic arm and robotic hand are controlled by a conventional control console, as stated, and are used to remove the bobbin of tipping paper from a place of storage, mount the bobbin on the desired machine, thread the machine with the undamaged tipping paper after any possibly damaged tipping paper has been removed from the bobbin, and remove the bobbin core from the machine after all of the tipping paper has been removed therefrom.

The robotic hand, which is connected to the conventional robotic arm by a rotatable coupling, has two sections disposed 90° apart. One section has a bobbin core-engaging device for engaging and holding fast thereto the bobbin core for the purpose of lifting and handling a bobbin. This section also has a bobbin transfer means in the form of a circular plate which is connected to a double acting fluid cylinder, so that when the cylinder is properly actuated, the plate will reciprocate in such a manner that the bobbin of tipping paper will be pushed from the bobbin core-engaging device and onto an idle spindle on the machine, thereby mounting the bobbin of the tipping paper on the machine.

The second section of the robotic hand at its distal end has a first and a second finger which form a clamping means. The first and second fingers which form the clamping means are in the form of two cooperating plates. The first and second fingers have rubber on their respective surfaces that contact one another. The first finger is fixed while the second finger is movable. These fingers are used for clamping at least one lamination thickness of tipping paper of the bobbin therebetween after delamination of a bobbin of tipping paper and holding the end of the tipping paper while the robotic arm and hand are indexed to thread the machine with the delaminated tipping paper from the bobbin.

The second section also has a bobbin core removing means formed by the fixed first finger and a movable third finger. The third finger is in the form of a bracket. The portion of the first finger that operates cooperatively with the third finger is in fact the opposite side of the first finger used to form the clamping means. The first and third fingers cooperate for engaging the bobbin core and removing it from the idle spindle after all of the tipping paper has been removed therefrom.

The robotic hand also has connected to it a camera for an optical system. The optical system, which also includes a monitor connected to the control console, is used for locating the bobbin cores of the bobbins of tipping paper in the place of storage of the bobbins.

The delaminator apparatus of the system of the invention is mounted on, for example, a laser perforator machine, typically used in processing tipping paper. More specifically, the delaminator is mounted on the end of the machine and has a portion that extends outward beyond the plane of the side of machine onto which the bobbin of tipping paper is mounted and a portion that extends inward of the plane of the side of the machine.

The delaminator apparatus is suitably controlled by the control console which controls rotation of the elongated member, positioning of the elongated member with respect to the periphery of bobbin of paper material and performing such other movements and operations of the delaminator for carrying out the method of the invention.

The portion of the delaminator apparatus of primary importance that extends outward from the plane of the side of the machine is the elongated member. This elongated member has two longitudinally extending oppositely disposed rectangular grooves defined in it. A first cutting knife is slidably disposed in the first groove and a second cutting knife is slidably disposed in the second groove. The two cutting knives are reciprocated in their respective grooves by a double acting fluid cylinder connected to the cutting knives. This double acting fluid cylinder is located within the portion of the delaminator apparatus disposed inward of the plane of the side of the machine onto which the bobbin of paper material is mounted.

The elongated member has incorporated therein vacuum suction means for engaging and holding at least the first outer lamination of tipping paper of the bobbin to the elongated member. The vacuum suction means comprises two general vacuum suction channels defined in the elongated member and vacuum suction directing means in fluid communication with the respective vacuum channels and the atmosphere. The two vacuum suction directing means are respectively disposed adjacent to the top edges of the sides of the first groove. When vacuum suction is applied through the vacuum suction directing means and the vacuum suction directing inserts are engaging the outermost lamination of tipping paper of the bobbin, at least the first lamination of tipping paper is held to the elongated member. The tipping paper is held in this manner so that the first cutting knife, as it reciprocates towards the distal end of the elongated member, cuts the tipping paper disposed across the first groove.

The elongated member of the delaminator apparatus is rotated about its longitudinal axis upon activation of a rotation motor. The rotation motor rotates the elongated member by directly driving a drive gear which in turn drives a driven gear connected to the elongated member. When the elongated member is rotated, the possibly damaged laminations of tipping paper are wound around the elongated member.

The elongated member is moved toward or away from the bobbin by a positioning motor which drives a threaded shaft which in turn drives the assembly of the delaminated apparatus of which the elongated member is a part.

In the method of the invention, the robotic arm with the robotic hand is moved to the place of storage of the bobbins. The robotic arm and robotic hand can be guided by the camera of an optical system mounted on the robotic hand. This optical system, as stated, also includes a monitor associated with the control console which is connected to the camera. However, it is contemplated that other sensing systems can be used for guiding the robotic arm and robotic hand for proper positioning of the robotic arm and robotic hand for inserting the bobbin core engaging device in the bobbin of the bobbin in the place of storage. Once the robotic arm and robotic hand are core properly positioned, the bobbin core-engaging device at the distal end of the first section of the robotic hand is disposed in and engages the interior surface of the bobbin core of the bobbin of tipping paper. After engagement, the bobbin in lifted and removed from the place of storage. The robotic arm and robotic hand are moved so that the bobbin core-engaging device is aligned with the idle spindle of a desired machine, and the bobbin transfer means is actuated to transfer the bobbin from the bobbin core-engaging device and seat the bobbin properly on the idle spindle of the machine, thereby mounting the bobbin on the machine Following the mounting step, the elongated member of the delaminator apparatus which extends perpendicularly outward from the plane of the side of machine engages the outermost lamination of tipping paper of the bobbin. After the engaging step is carried out, vacuum suction is applied through the vacuum suction channels and vacuum suction directing means to hold at least the outermost lamination of tipping paper of the bobbin to the elongated member of the delaminator apparatus by vacuum suction. Subsequent to the holding step, the elongated member with the first lamination so held moves a small distance away from the bobbin by activating the positioning motor which drives a threaded shaft in the proper direction causing the assembly of which the elongated member is a part to be driven the stated small distance away from the bobbin. After this moving step, the first cutting knife is reciprocated within the first longitudinal groove in the elongated member to cut the tipping paper disposed across the first groove across its width. Once the cutting step is completed, the vacuum suction is turned off with respect to one end of the tipping paper adjacent to the cut, thereby releasing that end which falls away from the elongated member of the delaminator apparatus, while the other end adjacent to the cut, which is connected to the remainder of the tipping paper of the bobbin, remains held to the elongated member by vacuum suction.

Following the holding and releasing step, the elongated member of the delaminator apparatus is moved farther away from the bobbin by again activating positioning motor to drive the threaded shaft causing movement of the assembly which includes the elongated member farther away from the bobbin of tipping paper. Simultaneous with this moving step, the rotation motor is activated to rotate the elongated member apparatus about its longitudinal axis to wind any possibly damaged outer laminations of tipping paper around the elongated member of the delaminator apparatus.

At the completion of the rotating and winding step, rotation of the elongated member is stopped. Following the stopping step, the first and second fingers disposed at the distal end of the first section of the robotic hand clamp the undamaged tipping paper extending between the elongated member apparatus and the bobbin. Subsequent to the clamping step, the second cutting knife is reciprocated within the second longitudinal groove in a direction opposite that which the first cutting knife was reciprocated in carrying out the first cutting step. When the second cutting knife is reciprocated, as described, it cuts through all thicknesses of tipping paper wound around the elongated member. After the second cutting step in which all of the thicknesses of tipping paper wound around the elongated member elongated member were cut, a new end of the undamaged tipping paper of the bobbin is formed and falls free of the but remains clamped between the first and second fingers of the robotic hand.

Also, upon completion of the second cutting step, vacuum suction is cut off with respect to the end of the tipping paper adjacent to the first cut previously being held.

After this releasing step, positive air pressure is provided through the previously described vacuum suction directing means in the elongated member apparatus to blow the cut thicknesses of tipping paper wound around the elongated member from it, thereby removing them.

Following completion of or simultaneous with the removal step, the robotic arm and hand, with the hand clamping the end of the undamaged tipping paper, are indexed to thread the machine with the undamaged tipping paper for processing of the tipping paper of the bobbin. After the threading step, the tipping paper of the bobbin is processed by the machine. During processing, as a time saving step, the robotic arm and hand can be guided to the place of storage of the undelaminated bobbins of tipping paper to load the next bobbin of tipping paper onto the bobbin core-engaging device of the robotic hand, so as soon as the processing operation is completed the next bobbin of tipping paper is ready to be mounted on the machine. Once processing is completed, the robotic arm and robotic hand having the next bobbin of tipping paper held thereto are indexed so the bobbin core removal means disposed at the distal end of the robotic hand removes the empty bobbin core from the idle spindle so a new bobbin of tipping paper can be placed on the machine for delamination and processing. This method is repeated whenever a new bobbin of tipping paper is disposed on the machine.

An object of the invention is to provide an automatic or semi-automatic system and method for handling and delaminating a bobbin of tipping paper which comprises of a robotic arm assembly for removing a new bobbin from a place of storage, mounting the bobbin of tipping paper on a processing machine, threading the machine with tipping paper of the bobbin and removing the bobbin core from the machine after the tipping paper has been removed therefrom, and a delaminator apparatus for delaminating any possibly damaged outer laminations of tipping paper of the bobbin.

BEST MODE FOR CARRYING OUT THE INVENTION

Figure 1:
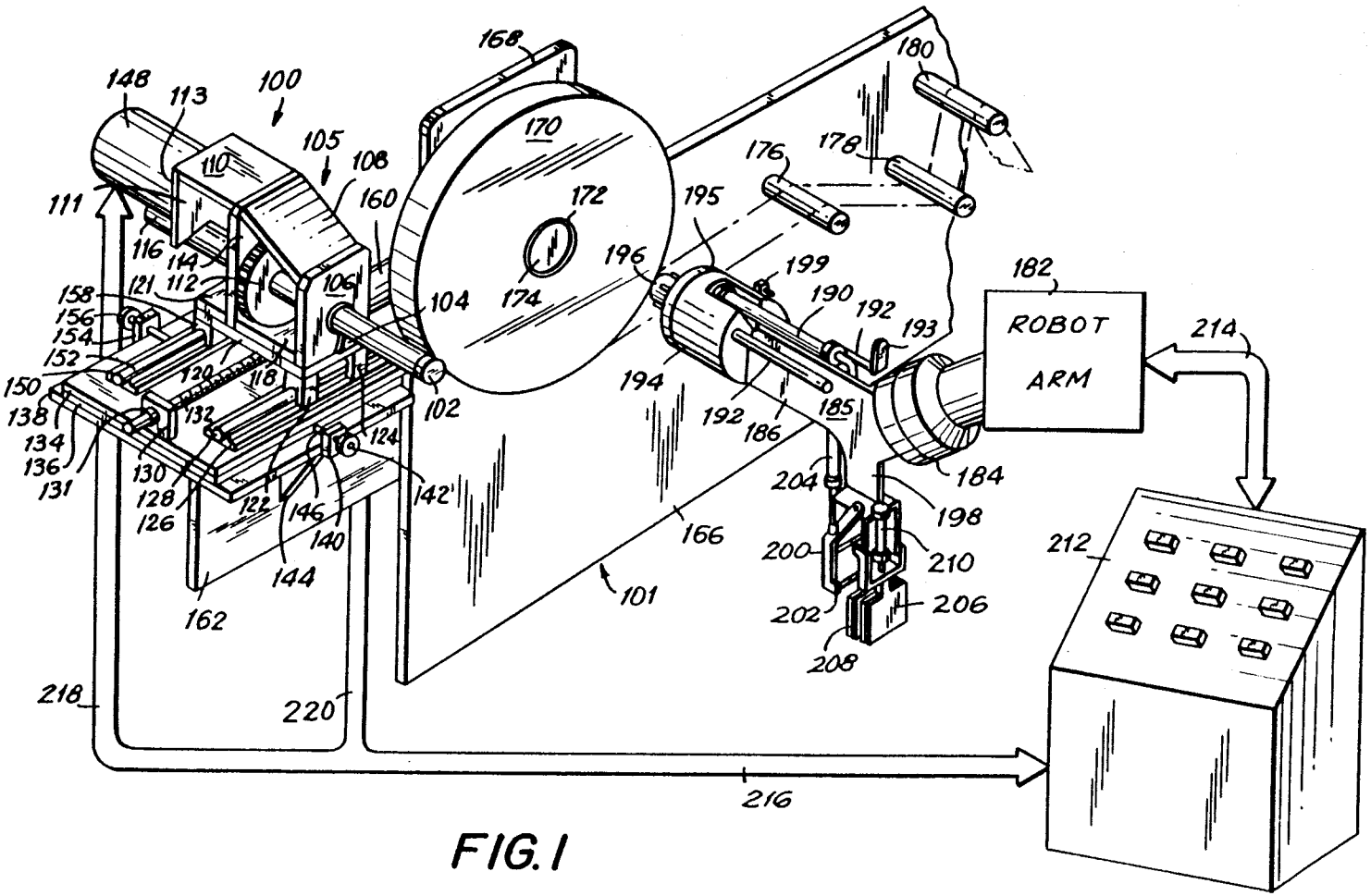
FIG. 1 shows an isometric elevational view of the system of the invention.
Figure 2:
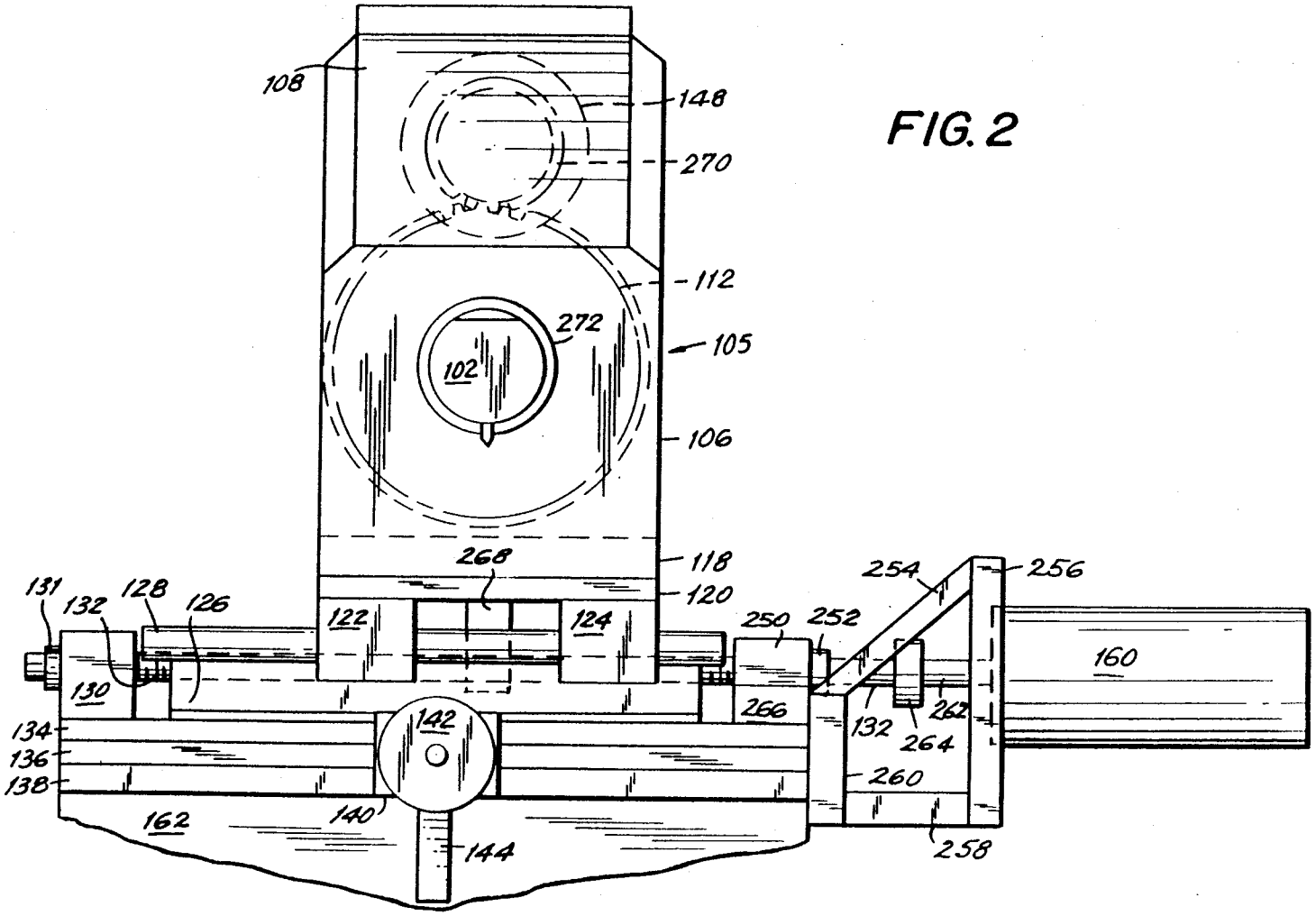
FIG. 2 shows a front view of the delaminator apparatus of the system of the invention.
Figure 3:
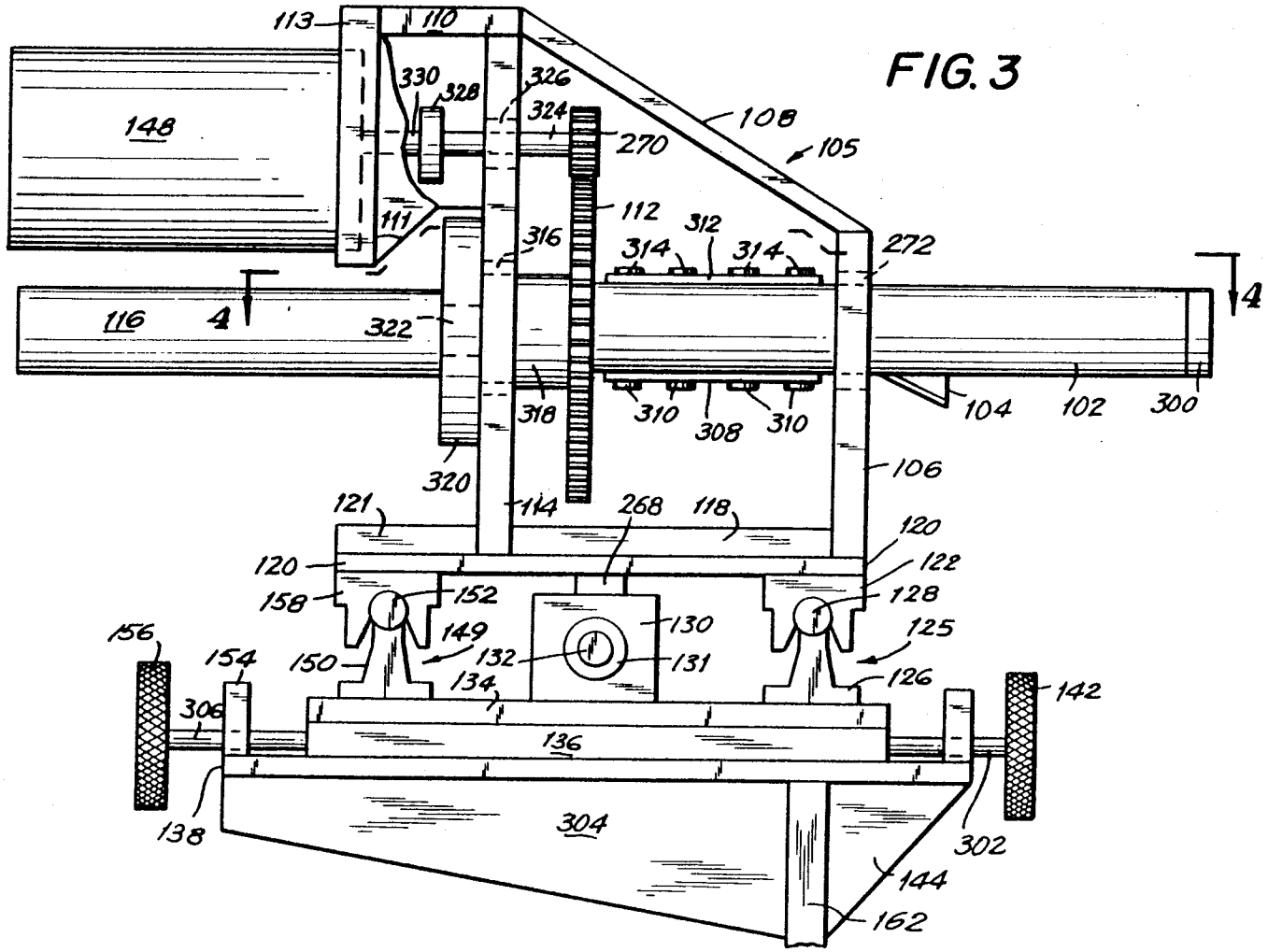
FIG. 3 shows a side view of the delaminator apparatus of the system of the invention.

FIG. 1 shows an isometric elevation view of the system of the invention. The system is comprised of a delaminator apparatus 100 mounted on, for example, a laser perforating machine 101, a conventional robotic arm 182 shown in block form of the type commercially available from Cincinnati Milicron Inc., of Cincinnati, Ohio, robotic hand 185 connected to the distal end of robotic arm 182 at rotatable coupling 184, and a conventional control console 212 for controlling the robotic arm 182, robotic hand 185 and delaminator apparatus 100. The system may be used with laser perforator machine 101 to perforate the tipping paper of the bobbin. However, the system of the invention is not limited to use only on laser perforating machines.

Referring to FIG. 1, control console 212 provides control information to robotic arm 182 and robotic hand 185 in a conventional manner via control line 214. The control console also provides control information to delaminator apparatus 100 in a conventional manner via control line 216 which in turn provides control information to rotation motor 148 via control line 218 and to positioning motor 160 via control line 220. The control console further controls the optical system and the input of air under pressure to various double acting fluid cylinders connected to robotic hand 185 for carrying out the method of the invention. Therefore, the control console controls the movements of robotic arm 182 and robotic hand 185, the optical system, and movements of delaminator apparatus 100 for carrying out specific functions in the method of the invention. The control functions as carried out by the control console are conventional and would be known to one skilled in the art.

Referring to FIGS. 1 through 9, the delaminator apparatus 100 will be described. Delaminator apparatus 100, as stated, is mounted on the side of, for example, a laser perforator. Vertical support member 162 is connected to machine 101 and is the basic support for delaminator apparatus 100. Connected to the top edge of the vertical support member 162 is horizontal support plate member 138. The remainder of the delaminator apparatus is support by these members.

Movable assembly plate 136 is disposed adjacent to the top surface of horizontal support plate member 138. Fixed to the top surface of movable assembly plate 136 is assembly connection plate 134.

Vertically disposed from and adjacent to the front and back edges of horizontal support plate member 138, respectively, are position blocks 140 and 154. Position block 140 receives therethrough in a screw/nut relationship threaded shaft 302 which has knob 142 fixed at its distal end. The proximal end of shaft 302 engages on front edge of movable assembly plate 136. Position block 152 receives therethrough in a screw/nut relationship threaded shaft 306 which has knob 156 fixed at its distal end. The proximal end of shaft 306 engages the back edge of movable assembly plate 136.

Knobs 142 and 156 are cooperatively turned to move delaminator assembly 105 in such a manner that elongated member 102 is properly positioned with respect to the edge of bobbin of tipping paper mounted on machine 101. More specifically, this movement will insure that the vacuum suction directing inserts 434 and 500 of elongated member 102 are properly positioned for carrying out the method of the system of the invention, as will be described.

Assembly connection plate 134 has connected to and disposed from its top surface near its front and back edges, respectively, rail assemblies 125 and 149. Rail assembly 125 disposed near the front edge of assembly connector plate 134 is substantially parallel to front edge of plate 134 and comprises rod support 126 and rod 128 surmounting rod support 126. Rail assembly 149 disposed near the back edge of assembly connection plate 134 is substantially parallel to the back edge of plate 134 and comprises rod support 150 and rod 152 surmounting rod support 150.

Connected to and disposed from the top surface of assembly connection plate 134 near opposing side edges of plate 134 are blocks 130 and 250, respectively. Blocks 130 and 250 have bores to receive respective ends of threaded positioning shaft 132. The portions of threaded positioning shaft 132 disposed through the respective bores in blocks 130 and 250 are smooth and not threaded so threaded positioning shaft can freely rotate in the bushings fixed in the respective bores.

The portion of shaft 132 between the blocks 130 and 250 is threaded and is used for driving delaminator assembly 105 of the deliminator apparatus 100 along lengths of rail assemblies 125 and 149 for carrying out the method of the system of the invention, as will be described.

The end of threaded positioning shaft 132 that extends beyond block 250 is received by coupling 264. The other side to coupling 264 receives the distal end of drive shaft 262 of positioning motor 160.

Positioning motor 160 is a stepper motor which when activated drives delaminator assembly 105 along rail assemblies 125 and 149 as will be described. Positioning motor 160 is supported by a mounting structure fixed to plate 134. The mounting structure comprises plate 256 to which positioning motor 160 is fixed, and members 254, 258, 260, 266 and their compliments on the other side of plate 256 (not shown) which connect plate 256 to assembly connection plate 134.

Delaminator assembly 105, which is driven along rail assemblies 125 and 149 by positioning motor 160 and threaded positioning shaft 132, has base plate 120 with slides 122 and 124 connected to and disposed from its bottom surface near its front edge, and slide 158 and a slide not shown disposed from its bottom surface near its back edge. Slides 122 and 124 slidably engage rod 128 of rail assembly 125, and slide 158 and the slide not shown slidably engage rod 152 of rail assembly 149. Connected to and disposed from the bottom surface of base plate 120 near its center is lug 268 which receive therethrough in a screw/nut relationship threaded shaft 132. When threaded shaft 132 is rotated by activation of positioning motor 160, delaminator assembly 105 is caused to move along rods 128 and 152 with its direction of movement dependent upon on the direction of rotation of positioning motor 160 and threaded shaft 132.

Disposed perpendicularly from the top surface of base plate 120 are vertically extending plates 106 and 114. Plates 106 and 114 are spaced away from one another with plate 106 disposed adjacent to the front edge, and plate 114 disposed near but spaced away from the back edge of base plate 120. Plate 114 has a greater height than plate 106.

Plate 108 is connected between the top edges of plates 106 and 114 and forms an acute angle with a horizontal plane parallel to the top edge of plate 106. Plates 106 and 114 are additionally supported by plate 118 connected to and disposed between plates 106 and 114. Plate 118 is also fixed to the top surface of base plate 120. Plate 114 is further supported by plate 121 connected to the opposite side of plate 114 than plate 118. Plate 121 is also fixed to base plate 120.

Plate 106 has a circular opening disposed through it which has bushing 272 fixed therein. Elongated member 102 is disposed through bushing 272 and freely rotates in bushing 272.

Plate 114 has two circular openings disposed through it. The first opening has bushing 326 fixed therein. Drive gear shaft 324 extends through bushing 326 and is freely rotatable therein. The distal end of drive gear shaft 324 is connected to drive gear 220. The proximal end of drive gear shaft 324 is received by coupling 328. The other side of coupling 328 receives the distal end of drive shaft 330 of rotation motor 148. Rotation motor 148 is a stepper motor which connects to a support structure connected to plate 114. The support structure comprises plate 110, plate 113, plate 111 and a plate (not shown) similar to 111 connected to the opposite side edges of plates 110 and 113.

The second opening in plate 114 is larger than the first opening and is preferably disposed below the first opening. The second opening has bushing 316 fixed therein and cylindrical member 401 of housing 400 is disposed through bushing 316 and freely rotates in bushing 316. Connected to the surface of plate 114 facing the back edge of plate 120 is fluid cylinder receiving plate 320. Receiving plate 320 has a threaded bore which is concentric with the second opening in plate 114. The threaded bore plate 320 receives therein the threaded end of double acting fluid cylinder 116.

Housing 400 comprises cylindrical member 401 and elongated member 102. The relationship of these sections of housing 400 with respect to double acting fluid cylinder 116 will be described. Double acting fluid cylinder 116 has connected thereto a push rod assembly which is used to drive the cutting knives of delaminator apparatus 100. The push rod assembly comprises push rod 406, coupling 408, knife push rod 410, spacers 412 and 414, bearing 416 and retaining ring 418.

Push rod 406 extends from the end of cylinder 116 fixed in plate 320. Push rod 406 extends into central bore 403 which extends through both cylindrical member 401 and elongated member 102. The distal end of push rod 406 is received by coupling 408. Extending from the other end of coupling 408 is knife push rod 410 which extends into the portion of central bore 403 in elongated member 102. Knife push rod 410 has two sections. The first section which extends from coupling 408 has a larger diameter than the second section which extends from approximately the mid point along the longitudinal length of knife push rod 410 to its distal end. At the junction between the first and second sections of knife push rod 410 an annular ledge is formed. First spacer 412 is disposed about the second section of knife push rod 410 adjacent to annular ledge. Second spacer 414 is spaced away from first spacer 412 and closer to the distal end of knife push rod 410. Both spacers are slip fit over the second section of knife push rod 410 and freely rotatable on knife push rod 410. Spacers 412 and 414 have longitudinal lengths such that when they are placed over knife push rod 410 with bearing 416 and retaining ring 418 also in place, an annular recess is formed between the spacers for receiving pins 422 and 424 connected to first cutting knife 420 and second cutting knife 428, respectively. With this arrangement, when the elongated member 102 is rotated, as will be described, pins 422 and 424 will freely rotate in the annular recess between spacers 412 and 414 but when double acting fluid cylinder 116 is activated, the knives of the delaminator can be properly driven in their respective grooves.

Cylindrical member 401 of housing 400 has annular ledge 409 which has driven gear 112 fixed to it. Driven gear 112 has teeth disposed at its peripheral edge which mesh with the teeth of drive gear 270. When rotation motor 148 is activated, drive gear 270 rotates causing driven gear 112 to rotate. Driven gear 112 in turn causes cylindrical member 401 and elongated member 102 of housing 400 to rotate for carrying of the method of the invention.

Referring to elongated member 102 of housing 400, first cutting knife 420 is disposed in rectangular groove 430 and second cutting knife 428 is disposed in rectangular groove 432. Pin 422 is connected to first cutting knife 420 and pin 424 is connected to second cutting knife 428. The distal ends of these pins are disposed in the annular recess between spacers 412 and 414. Pins 422 and 424 are also disposed through slots 439 and 441, respectively. These slots serve to limit the forward and rearward travel of the respective pins and therefore the respective knives to which they are connected. Once first cutting knife 420 and second cutting knife 428 are placed within grooves 430 and 432, respectively, cover plates 312 and 308 cover the portion of the grooves rearward of plate 106. The plates are secured over the respective grooves with, for example, the plurality of cap screws 314 and 310, respectively. Cylindrical member 401 of housing 400 has annular grooves 402 and 404 (FIG. 4) disposed near its end adjacent to plate 320. Annular grooves 402 and 404 are in fluid communication with general vacuum channels 520 and 522, respectively, in elongated member 102 via respective bores (not shown) in cylindrical member 401. Disposed between the grooves 402 and 404 and on either side of the grooves are O-rings 407. O-rings 407 seal the respective grooves from air leakage. Annular grooves 402 and 404 are in fluid communication by separate bores in plate 114 which connect to a individual vacuum suction/air generating means (not shown).

Double acting fluid cylinder 116 used for driving knives 420 and 428 is of a conventional type. It is to be understood that one skilled in the art would be familiar with the activation and use of such double acting fluid cylinders, so further description of them is unnecessary.

Figure 4:
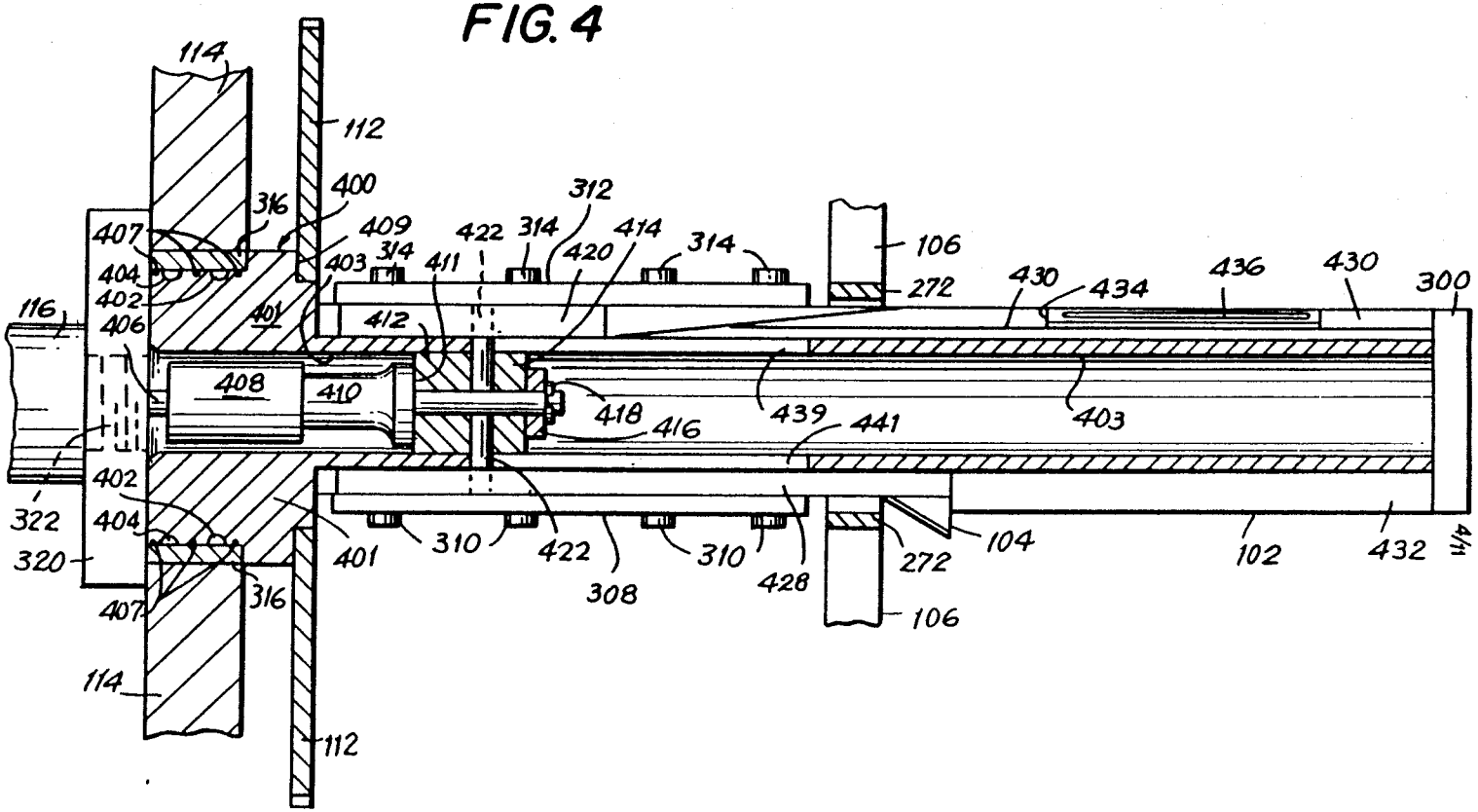
FIG. 4 shows a partial longitudinal cross-sectional view of the preferred embodiment of a portion of the delaminator apparatus at 4—4 of FIG. 3.
Figure 5:
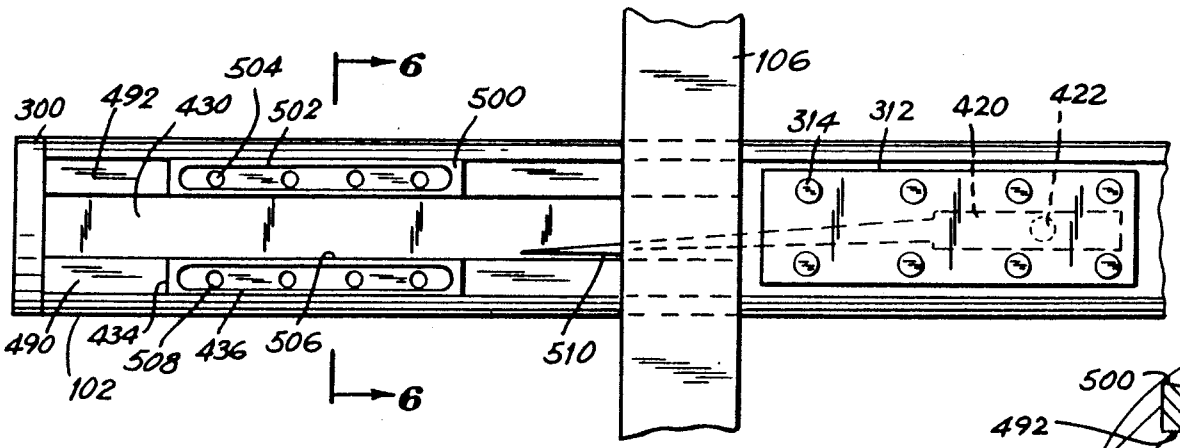
FIG. 5 shows a partial top perspective view of the preferred embodiment of the elongated member of the delaminator apparatus of the system of the invention.
Figure 6:
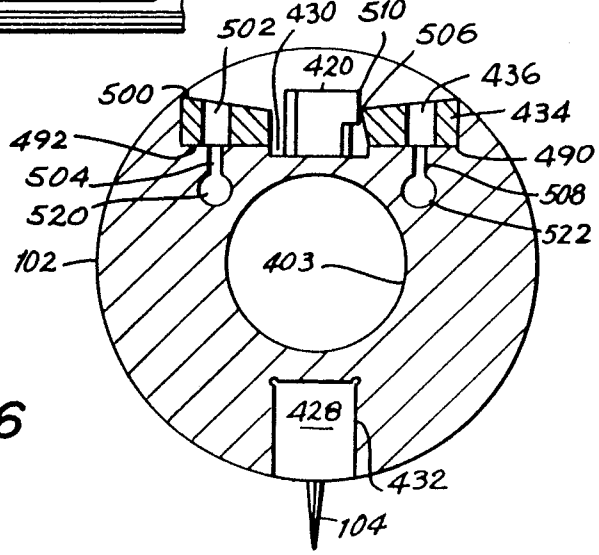
FIG. 6 shows a cross-sectional view of the preferred embodiment of the elongated member of the delaminator apparatus of the invention at 6—6 of FIG. 5.

Referring to FIGS. 4, 5 and 6, elongated member 102 has longitudinally extending rectangular groove 430. Longitudinally extending rectangular groove 430 is stepped and disposed symmetrically about a longitudinally extending vertical plane through the centerline of elongated member 102. Disposed on first step levels 490 and 492, on opposite sides of groove 430 are vacuum suction directing inserts 434 and 500, respectively. Vacuum suction directing inserts 434 and 500 have top surfaces which slope upwardly from their respective edges closest to the centerline of groove 430. Vacuum suction directing inserts 434 and 500 are interchangeable with inserts of different lengths to accomodate different widths of tipping paper. Inserts 434 and 500 have longitudinal openings 436 and 502, respectively. These longitudinal openings are in fluid communication with general vacuum channels 522 and 520 via vacuum suction orifices 508 and 504, respectively.

First cutting knife 420 is disposed in groove 430. In FIGS. 4 and 5, knife 420 is shown in its first position. The second position of knife 420 is disposed in the area between vacuum suction directing inserts 434 and 500 in groove 430. Knife 420 is reciprocated between these two positions within groove 430 by double acting fluid cylinder 116. The push rod assembly comprising push rod 406, coupling 408, knife push rod 410, spacers 412 and 414, bearing 416 and retaining ring 418 connected to double acting fluid cylinder 116 is connected to knife 420 via pin 422 as stated, so when double acting fluid cylinder 116 is actuated in a first instance, knife 420 will reciprocate from first position, as shown in FIGS. 4 and 5, to a second position between vacuum suction directing inserts 434 and 500. When the cylinder is actuated in a second instance, knife 420 will reciprocate from the second position back to the first position.

Edge 506 of vacuum suction directing insert 434 and cutting surface 510 of knife 420 cooperate for cutting the tipping paper of the bobbin held by vacuum suction across groove 430. When knife 420 is reciprocated from the first position to the second position, surface 510 of knife 420 contacts edge 506 of vacuum suction directing insert 434 in such a manner that the tipping paper disposed across groove 430 is sheared by surface 510 and edge 506.

Second cutting knife 428 disposed in groove 432 has angled cutting blade 104 that extends radially outward from elongated member 102. Cutting knife 428 is connected to double acting fluid cylinder 116 via the push rod assembly and pin 424. As described for the reciprocation of knife 420, when double acting fluid cylinder 116 is actuated in a first instance, knife 428 is reciprocated from a first position, as shown in FIGS. 4 and 5, to a second position within groove 432 such that blade 104 of knife 428 is adjacent to end cap 300 at the distal end of elongated member 102. When double acting fluid cylinder 116 is actuated in a second instance, knife 428 will reciprocate from the second position back to the first position shown in FIGS. 4 and 5. Knife 428 is used for cutting thicknesses of possibly damaged tipping paper wound around elongated member 102 as will be described in discussing the method of the invention.

Although, FIGS. 4 and 5 show that knives 420 and 428 are reciprocated by double acting fluid cylinder 116 via the push rod assembly, it is within the scope of the invention that separate drive means can be used for reciprocating each knife independently.

Figure 7:
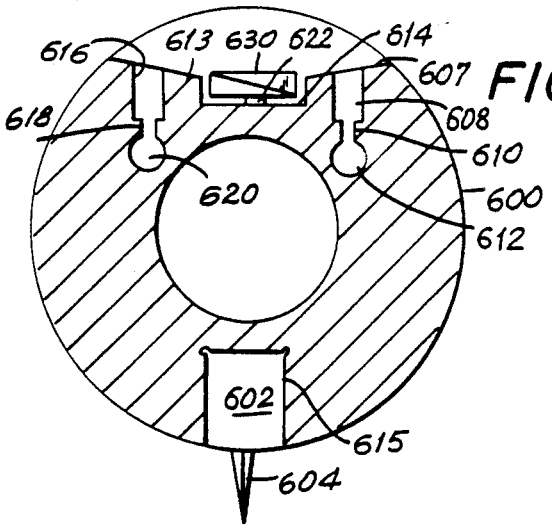
FIG. 7 is a cross-sectional view similar to FIG. 6 showing a second embodiment of the elongated member of the delaminator apparatus of the invention.

FIG. 7 is a cross-sectional view, similar to FIG. 6, showing a second embodiment of elongated member 102 of the delaminator apparatus of the system of the invention. In the second embodiment, elongated member 600 has opposingly disposed longitudinally extending rectangular grooves 614 and 615. Adjacent to the top edges of the respective sides of groove 614 are upwardly sloping surfaces 607 and 613. Defined in the upwardly sloping surfaces 607 and 613 are longitudinal openings 608 and 616, respectively. Openings 608 and 616 are in fluid communication with general vacuum channels 612 and 620 via sets of vacuum suction orifices 610 and 618, respectively.

Figure 8:
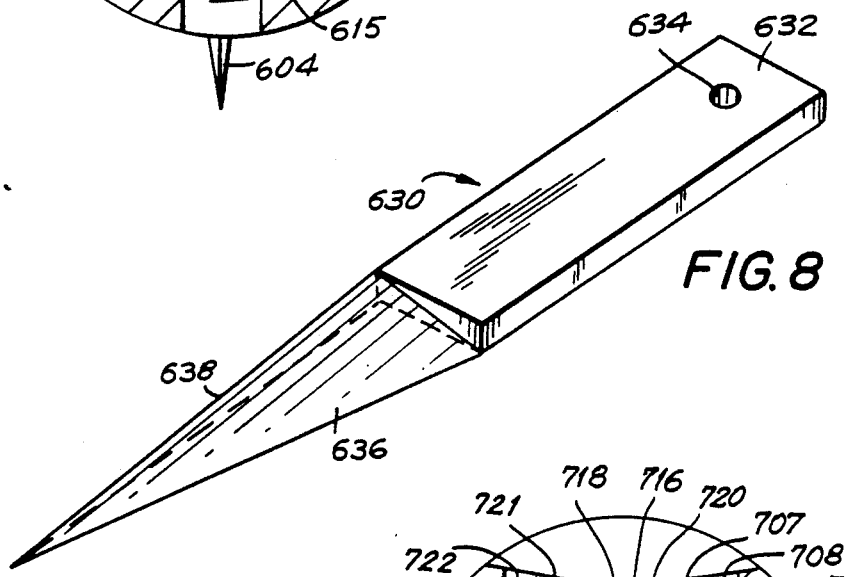
FIG. 8 shows an isometric bottom view of the first cutting knife for use in the second and third embodiments of the elongated member of the delaminator apparatus of the system of the invention.

FIG. 8 shows first cutting knife 630 used in the second embodiment of the elongated member of the delaminator apparatus of the system of the invention, shown in FIG. 7. Knife 630 has rectangular body 632 and cutting blade 636. Rectangular body 632 has opening 634 for receiving pin 422. Blade 636 has cutting edge 638 which is used to cut the tipping paper disposed across groove 614, as will be described.

Second cutting knife 602 with blade 604 is substantially the same as knife 434 having blade 104 shown and described in the preferred embodiment of the elongated member of the delaminator apparatus of the system of the invention.

Knives 630 and 602 are reciprocated in grooves 614 and 615, respectively, in substantially the same manner as described for reciprocating knives 420 and 428 in the preferred embodiment of the delaminator apparatus of the system of the invention.

Figure 9:
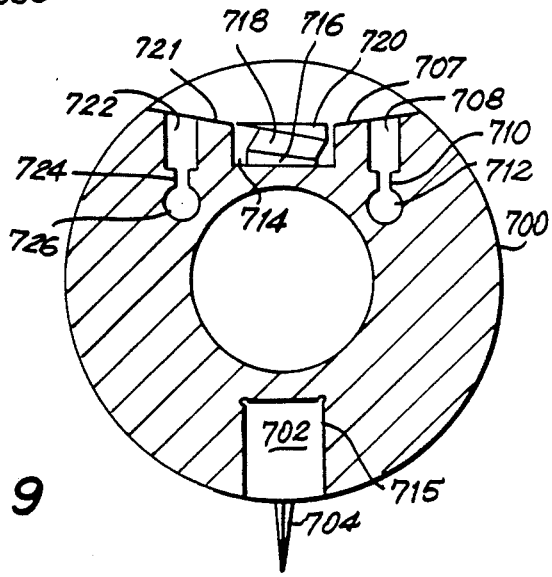
FIG. 9 is a cross-sectional view similar to FIG. 6 showing a third embodiment of the elongated member of the delaminator apparatus of the invention.

FIG. 9 is a cross-sectional view, similar to FIG. 6, showing a third embodiment of the elongated member of the delaminator apparatus of the system of the invention. Elongated member 700 of the third embodiment, has opposingly disposed longitudinally extending rectangular grooves 714 and 715. Adjacent to the top edges of the respective sides of groove 714 are upwardly sloping surfaces 707 and 721. Defined in upwardly sloping surfaces 707 and 721 are longitudinal openings 708 and 722, respectively. Openings 708 and 722 are in fluid communication with general vacuum channels 712 and 726 via sets of vacuum suction orifices 710 and 724, respectively.

First cutting knife 720 having blade 376 is substantially the same as knife 630 shown and described in FIG. 8 used in the second embodiment of the elongated member of the delaminator apparatus of the invention.

The third embodiment of the elongated member of the delaminator apparatus of the system of the invention also has blade support structure 716 with pad 718 attached to its the top surface disposed in groove 714. Blade support structure 716 with pad 718 attached to its top surface are disposed between longitudinal openings 708 and 722. The top of blade support structure 716 is shaped so that when knife 720 is reciprocated to its second position between the longitudinal openings, the beveled bottom surface of the blade will contact the top surface of pad 718 along its entire length. The purpose for the cooperative action of knife 720 and pad 718 will be described subsequently.

Second cutting knife 702 with blade 704 is substantially the same as cutting knife 428 having blade 104 shown and described in the preferred embodiment of the delaminator of the invention.

Knives 720 and 702 are reciprocated in grooves 356 and 715, respectively, in substantially the same manner described for reciprocation of knives 420 and 428 in the preferred embodiment of the elongated member of the delaminator apparatus of the system of the invention.

Figure 10:
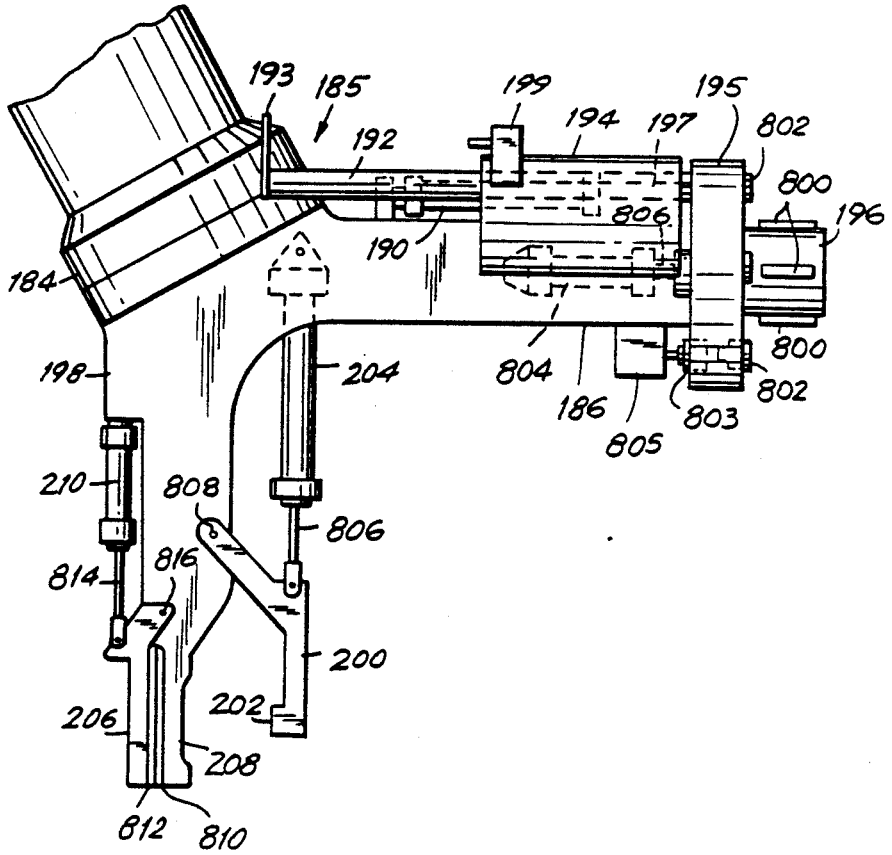
FIG. 10 shows an enlarged side view of the robotic hand of the robotic arm assembly shown in FIG. 1.

Referring to FIGS. 1 and 10, robotic arm 182 having robotic hand 185 will be described. As previously stated, robotic arm 182 is conventional and of the type commercially available from Cincinnati Milicron Inc. of Cincinnati, Ohio. Robotic hand 185 is novel and connected to the distal end of robotic arm 182 by rotatable coupling 184. Robotic hand 185 has sections 186 and 198 disposed 90° apart. Section 186 of robotic hand 185 has the tubular housing of bobbin core-engaging device 196 disposed at the distal end. The tubular housing of bobbin core-engaging device 196 has a diameter less than the inside diameter of the opening in bobbin core 172 of bobbin 170. Extending radially outward from bobbin core-engaging device 196 are four equally circumferentially spaced bobbin core engagement members 800. However, it is within the scope of the invention that there can be three or more equally circumferentially spaced bobbin core-engagement members. Bobbin core-engaging members 800 extend from the interior of bobbin core-engaging device 196 through respective openings in the tubular housing. Engagement members 800 are used to engage the interior surface of bobbin core 172 so bobbin 170 can be lifted from its place of storage (not shown) and handled for mounting the bobbin on idle spindle 174 of machine 101. The means by which engagement members 800 are deployed radially outward from bobbin core-engaging device 196 to engage bobbin core 172 will be described in detail subsequently.

Push plate 195, which is disposed about bobbin core-engaging device 196, is a circular shaped plate having a central bore of a diameter larger than the outside diameter of bobbin core-engaging device 196. On one side of push plate 195 are disposed a plurality pressure sensitive pads 802 which are biased outward from this side of push plate 195 by springs Pressure sensitive pads 802 have two functions: (1) when a bobbin of tipping paper 170 is transfered bobbin core-engaging device 196 to the idle spindle 174 and the push plate 195 is not exactly parallel to the machine flange (not shown) disposed about idle spindle 174, the pads will bias outward from push plate 195 to force the side of the bobbin of tipping paper against the machine flange to compensate for the non-parallel disposition of the machine flange and the side of push plate 195; and (2) pressure sensitive pads 802 are is used in conjunction with switch 805 to indicate when the bobbin core-engaging device 196 is properly disposed within a bobbin core with the side of push plate 195 contacting the side of the bobbin of tipping paper to be removed from the place of storage as will be described subsequently.

The second side of push plate 195 has extending therefrom in association with at least one pressure sensitive pad 802, intermediate member 803. Intermediate member 803 is disposed in push plate 195 such that when pressure sensitive pad 802 is depressed into push plate 195, pad 802 contacts intermediate member 803.

Fixed to section 186 of robotic hand 185 is switch 805. Switch 805 is positioned on section 186 so that when push plate 195 is in its retracted position about bobbin core-engaging device 196, intermediate member 803 contacts switch 805. In operation, when bobbin core-engaging device 196 is being disposed within a bobbin core, pressure sensitive pads 802 are caused to be depressed into push plate 195. When pads 802 are fully depressed into push plate 195, a side of push plate 195 is against the side of bobbin of tipping paper 170. Also, when pressure sensitive pad 802 are depressed in this manner, it will contact intermediate member 803 causing switch 805 to close indicating that push plate 195 and bobbin core-engaging device 196 are is in their proper positions. When switch 805 is closed, control console 212 receives a signal causing robotic arm 182 and robotic hand 185 to cease moving bobbin core-engaging device 196 downwardly into the bobbin core and further causes the engagement members of the bobbin core-engaging device to engage the interior surface of the bobbin core to hold it fast thereto.

The second side of push plate 195 has connected thereto guide rods 192 which are disposed through and supported by guides 194. Guide rods 192 and guides 194 insure that push plate 195 maintains a true direction of travel when reciprocated toward machine 101 in transfering bobbin of tipping paper 170 from bobbin core-engaging device 196 to idle spindle 172 of machine 101.

Push plate 195 is reciprocated by double acting fluid cylinder 190. Double acting fluid cylinder 190 has push rod 197 (shown in phantom) extending therefrom with its distal end connected to push plate 195 on the same side guide rods 192 are connected.

At least one guide road has connected to its distal end switch actuator 193. Switch actuator 193 is disposed perpendicular to guide rod 192 and aligned with switch 199 mounted near the end of guide 194 nearest switch actuator 199. Switch 199 and switch actuator 193 are used to assist for determining the height, Z, which is the current height of the top of the stacks of undelaminated bobbins above the ground as will be described The height, Z, is determined so that the robotic hand and arm can be moved to the place of storage for removal of bobbins of tipping paper 170 therefrom for delamination and processing without the problem striking the side of the stack of bobbins during this removal operation.

Normally, the undeliminated bobbins of tipping paper are delivered to the place of storage on pallets. A pallet usually contains five stacks of bobbins with six bobbins in each stock. To determine the height, Z, of a representative stack, double acting fluid cylinder 190 is actuated causing push rod 197 to reciprocate outward from the distal end of section 186, which also causes push plate 195 connected to the distal end of push rod 197 to reciprocate in that direction. As push plate 195 reciprocates as described, guide rod 192 along with guide 194 ensures the true direction of travel of push plate 195. When push plate 195 has reached its position of fullest extension, switich actuator 193 contacts and closes switch 199. Once in this position, robotic arm 182 and robotic hand 185 are indexed so that section 186 of robotic hand 185 is directed downwardly. With robotic hand 185 positioned over one of the five stacks of bobbins 170 with section 186 directed downwardly, robotic hand 185 is lowered with push plate 195 in this extended position. As robotic hand 195 is lowered first pressure sensitive pads 802 are depressed into push plate 195 and then the side of push plate 195 contacts the top of the stack of bobbins of the tipping paper. When the side of push plate 195 contacts the top of the stack of bobbins, the momentum of the arm and hand will cause push rod 197 to be forced into double acting fluid cylinder 190 a small amount. This movement also causes switch actuator 193 to no longer contact switch 199 thereby opening switch 199. When switch 199 opens, a signal is sent to control console 212 and the height, Z, of the top of the stack of bobbins is noted by control console 212. The height, Z, is determined by first taking the height of the distal end of bobbin core-engaging device 196, above, the ground, which becomes a known value when the switch 199 is opened, and subtracting from that amount the distance from the distal end of bobbin core-engaging device 196 to the side of push plate 195 contacting the top of the stack of bobbins which is a fixed value when push plate 195 is in its extended position. Once the height, Z, is determined, the optical system determines the positions of the bobbin cores for one layer of bobbins. That is, the position of the bobbin cores for each of the five bobbins of tipping paper at the top of the five stacks. With the position the bobbin cores known and the height, Z, now known, robotic arm 182 and robotic hand 185 can be moved to the position of the bobbin cores for insertion therein of bobbin core-engaging device 196 for removal of bobbins of tipping paper 170 from their place of storage. This procedure for determining height, Z, and the position of the bobbin cores is carried out for each layer of bobbins of tipping paper 170 on the pallet.

Section 198 of robotic hand 185 is used for clamping the end of the delaminated tipping paper from the bobbin, threading machine 101 with tipping paper from the bobbin, and removing bobbin core 172 from machine 101 after the tipping paper has been removed therefrom. Section 198 of robotic hand 185 has first finger 208, which is in the form of a plate, fixed to section 198. First finger 208 has disposed on the side cushion surface 810, preferably made from rubber or other deformable material.

Section 198 has second finger 206 in the form of a plate pivotably attached to section 198 at 816. Double acting fluid cylinder 210 having push rod 814 is connected between section 198 and second finger 206 for oscillation of finger 206 about pivot point 816. Second finger 206 has disposed on the side facing first finger 208 cushioned surface 812, also preferably made from rubber or other deformable material. Second finger 206 operates cooperatively with first finger 208 for purposes of clamping tipping paper between the first and second fingers as will be described.

When double acting fluid cylinder 210 is actuated in one direction, second finger 206 oscillates toward first finger 208 so that there is a clamping engagement between the fingers. When actuated in an opposite direction, second finger 206 oscillates away from first finger 208 and a gap is formed between the fingers.

Third finger 200 in the form of a bracket is pivotably connected to section 198 at 808. Third finger 200 has an angled body with gripping pads 202 attached adjacent to its distal end. Third finger 200 cooperates with an opposite side of first finger 208 for removal of empty bobbin core 172 after the tipping paper has been removed therefrom. This second side of first finger 208 has disposed thereon gripping pads similar to gripping pad 202 disposed on it.

Double acting fluid cylinder 204 having push rod 806 is connected between the section 198 and finger 200 and oscillates finger 200 about pivot point 808. When double acting fluid cylinder 204 is actuated in one direction, third finger 200 oscillates toward the second side of first finger 208 and, when actuated in the opposite direction oscillates away from first finger 208 providing a larger gap between first finger 208 and the third finger 200.

Referring to FIGS. 11, 12, 13 and 14, the embodiments of the bobbin core-engaging device will be described.

Figure 11:
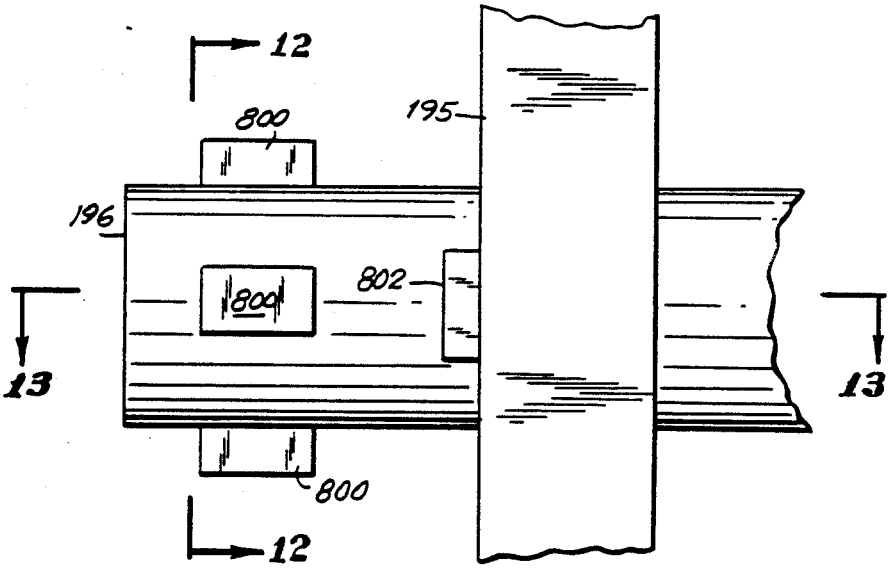
FIG. 11 shows an enlarged fragmentary side view of the bobbin core-engaging device disposed at the distal end of the first section of the robotic hand shown in FIG. 10.
Figure 12:
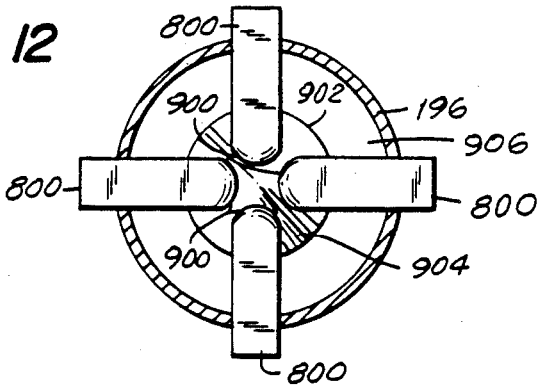
FIG. 12 is a cross-sectional view of the preferred embodiment of the bobbin core-engaging device at 12—12 of FIG. 11.
Figure 13:
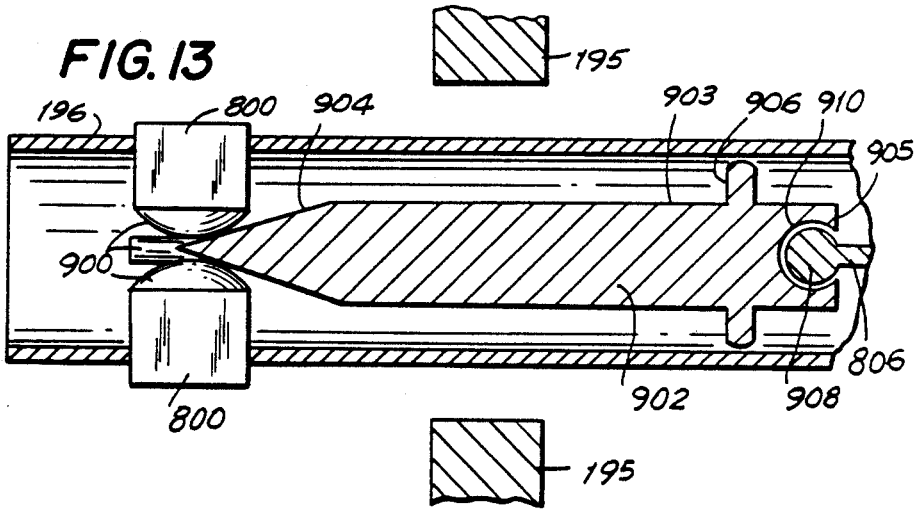
FIG. 13 shows a longitudinal cross-sectional view of the preferred embodiment of the bobbin core-engaging device shown at 13—13 of FIG. 11.

In FIGS. 11, 12, and 13, the preferred embodiment of the bobbin core-engaging device disposed at the distal end of section 186 of robotic hand 185 is shown. Bobbin core-engaging device 196 is configured so it may be inserted into bobbin core 172 of bobbin 170 to hold bobbin 170 fast thereto for the movement and handling of bobbin 170. In order for bobbin 170 to be held fast to bobbin core-engaging device 196, once the device is inserted into bobbin core 172, the plurality of engagement members 800 are driven radially outward from the device 196 to contact the interior surface of bobbin core 172 for holding the bobbin fast to the robotic hand.

Engagement members 800 are generally rectangular in shape and have rounded ends 900 (FIGS. 12 and 13) disposed in the interior of the housing of bobbin core-engaging device 196 near the longitudinal centerline. The plurality of engagement members 800 extend from the interior through respective openings in the tubular housing of device 196. The ends of engagement members 800 on the exterior of tubular housing 196 are substantially flat.

Referring to FIG. 13, showing a longitudinal cross-sectional view of the preferred embodiment of bobbin core-engaging device 196, elongated force transmission member 902 is disposed within the tubular housing of device 196. Force transmission member 902 has one end connected to end 908 of push rod 806 of double acting fluid cylinder 804 and the other end contacts rounded ends 900 of the plurality of engagement member 400. Force transmission member 442 has two sections. First section 903 is elongated having socket 910 defined in end 905 for receiving therein ball 908 disposed at the distal end of push rod 806 of double acting fluid cylinder 804 (FIG. 10). Ball 908 and socket 910 mate in a ball and socket relationship. Disposed near, but spaced away from, end 905 is annular flange 906. Flange 906 has an outside diameter slightly less than the inside diameter of the tubular housing of device 186. Annular flange 906 is used to pivot force transmission member 902 as will be described subsequently.

Second section 904 of force transmission member 902 is a tapered section. Second section 904 tapers from the diameter of first section 903 to a point. A portion of tapered second section 904 is disposed between and contacts rounded ends 900 of the plurality of engagement members 800. It is the interaction of force transmission member 902 and engagement members 800 that make it unnecessary to center bobbin core-engaging device 196 within bobbin core 172 when engaging the interior surface of bobbin core 172, as will be described.

When a new bobbin of tipping paper is required to be disposed on, for example, machine 101 for processing, bobbin core-engaging device 196 is inserted in bobbin core 172 of the new bobbin tipping paper 170 in a place of storage. Once the device is inserted in bobbin core 172, double acting fluid cylinder 804 is actuated causing push rod 806 to reciprocate in a direction toward the distal end of device 196. This reciprocation of push rod 806 causes force transmission member 902 to reciprocate in the same direction. The reciprocation of force transmission member 902 in this direction causes the rounded ends of the plurality of engagement members 800 to ride up tapered second section 904 until the flat ends of the respective engagement members contact the interior surface of bobbin core 196. Since bobbin core-engaging device 196 is not necessarily centered within bobbin core 172, engagement members 800, when driven radially outward, contact the interior surface of bobbin core 172 at different times. The first member, 800, that contacts the interior surface of bobbin core 172 will cause the force transmission members to be displaced in a direction opposite to the direction of radially outward movement of that engagement member as tapered section 904 continues to drive the remaining engagement members radially outward to engage the interior surface of bobbin core 172. When this happens, force transmission member 902 will pivot slightly about annular flange 906 within the tubular housing Once all of engagement members 800 have contacted the interior surface of bobbin core 172, there will be equal pressure on all engagement members 800 and the engagement members will hold bobbin core 172 on bobbin 170 of tipping paper fast thereto. However, force transmission member 902 and the tubular housing of bobbin core-engaging device 196 will usually be displaced from their original concentric relationship but the housing will be in the same position it assumed when it was inserted in bobbin core 172.

Figure 14:
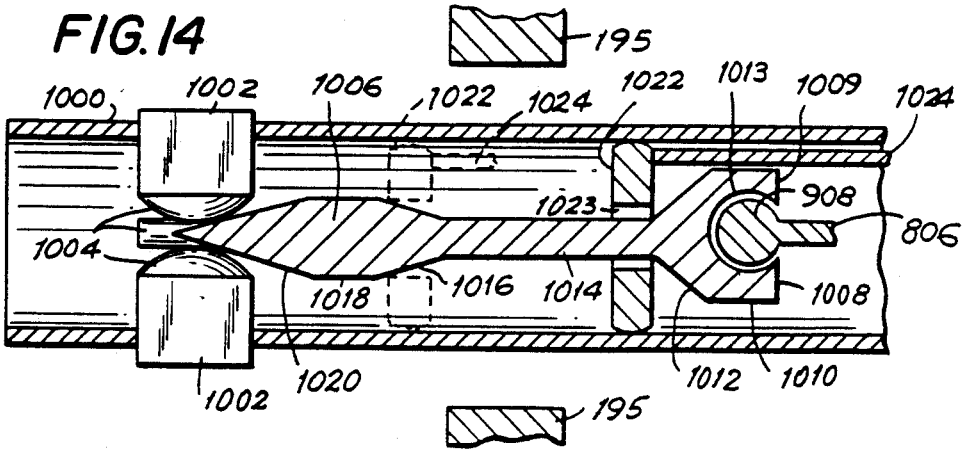
FIG. 14 is a longitudinal cross-sectional view similar to FIG. 13 showing a second embodiment of the bobbin core-engaging device.

Referring to FIG. 14, a second embodiment of the bobbin core-engaging device is shown. In the second embodiment, bobbin core-engaging device 1000 is similar to bobbin core-engaging device 196 in the preferred embodiment except force transmission member 1006 is substantially different from force transmission member 902 in the preferred embodiment, and the housing of bobbin core-engaging device 1000 can be centered within the bobbin core after engagement members 1006 engage the interior surface of bobbin core 172.

Force transmission member 1006 has six sections. First section 1010 is disposed at first end 1009 of member 1006 and has a first diameter. End 1009 has defined therein socket 1013 which receives ball 908 disposed at the distal end of push rod 806 of double acting fluid cylinder 804. Socket 1013 and ball 908 mate in a ball and socket relationship. Second section 1012 is tapered and tapers from the first diameter to a lesser second diameter. Third section 1014 is an elongated section having the second diameter. Fourth section 1016 is an outwardly tapering section that tapers from the second diameter to a third diameter larger than the second diameter. Fifth section 1018 is a short section having the third diameter. Sixth section 1020 is tapered and tapers from the third diameter to a point. A portion of tapered sixth section 1020 is disposed in the area between and contacts rounded ends 1004 of bobbin core engagement members 1002 disposed near the longitudinal centerline of the tubular housing of bobbin core-engaging device 1000. Disposed about third section 1014 is repositioning member 1022 having central bore 1023. The cooperative actions of force transmission member 1006 and repositioning member 1022 cause the tubular housing of the device to be centered within bobbin core 172, as will be described.

When a new bobbin of tipping paper is required to be disposed on, for example, machine 101 for processing, bobbin core-engaging device 1000 is inserted in bobbin core 172 of new bobbin of tipping paper 170 in a place of storage. Once bobbin core-engaging device 1000 is properly inserted in bobbin core 172, double acting fluid cylinder 804 is actuated causing push rod 806 to reciprocate in a direction toward the distal end of device 1000. The reciprocation of push rod 806 causes force transmission member 1006 to reciprocate in the same direction. The reciprocation of force transmission member 1006 in this direction causes rounded ends 1004 of the plurality of engagement members 1002 to ride up tapered sixth section 1020 and be driven radially outward from the housing until the respective engagement members contact the interior surface of bobbin core 172. Since bobbin core-engaging device 1000 is not necessarily centered within bobbin core 172, engagement members 1002 when driven radially outward, contact the interior surface of bobbin core 172 at different times. The first member 1002 to contact the interior surface of bobbin core 172 will cause the force transmission member to be displaced in a direction opposite the direction of radially outward movement of that engagement member as tapered section 1020 continues to drive the remaining engagement member radially outward. When this happens, force transmission member 1006 will pivot about repositioning member 1022.

Bobbin core-engaging device 1000 has the feature that once it has engaged the interior surface of bobbin core 172 with engagement members 1002, the device housing can be repositioned and centered with respect to the interior surface of bobbin core 172 and force transmission means 1006. In order to center the tubular housing of device 1000 within bobbin core 172, a double acting fluid cylinder (not shown) having at least push rod 1024 with its distal end connected to repositioning member 1022 is actuated. Actuation of this cylinder causes push rod 1024 to reciprocate in a direction toward the distal end of device 1000. This reciprocation in turn causes repositioning member 1022 to reciprocate in the same direction. During this reciprocation, repositioning member 1022 will travel the length of third section 1014 and ride up tapered fourth section 1016 until it reaches the second position of repositioning member 1022 shown in phantom. In this movement of repositioning member 1022 to its second position, the housing is centered about force transmission member 1006 without affecting the contact of engagement members 1002 in their holding relationship with bobbin core 172. This movement of repositioning member 1022 also causes the housing to be centered with respect to bobbin core 172.

Figure 15:
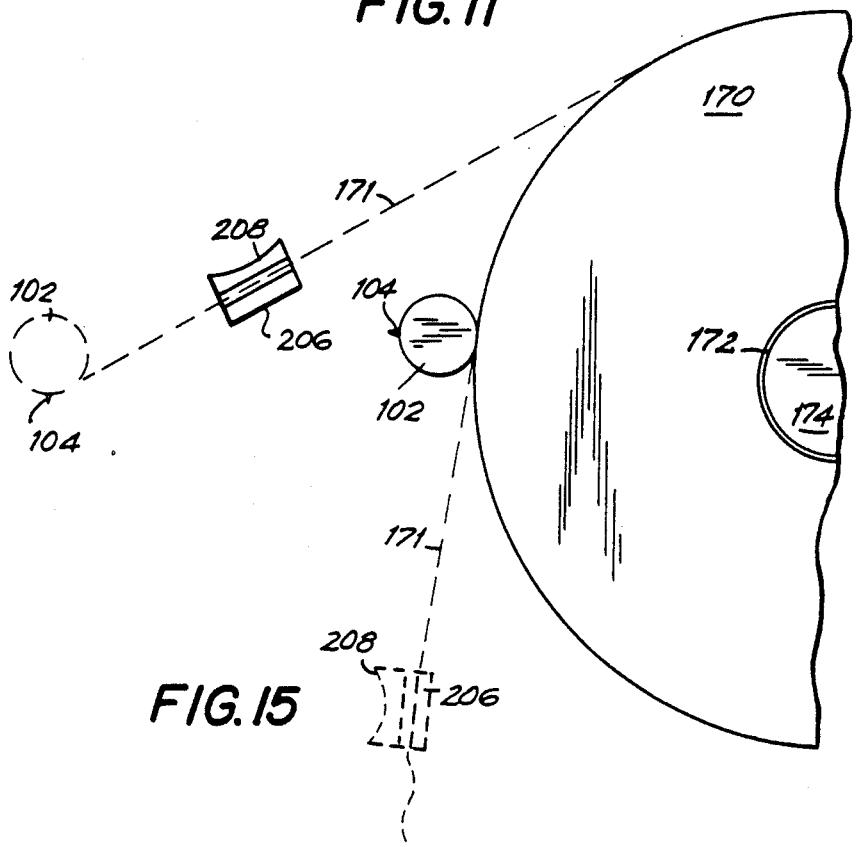
FIG. 15 is a fragmentary schematic side view of the bobbin of tipping paper showing the positions of the the elongated member of the delaminator apparatus in carrying out the method of the invention.
Figure 16:
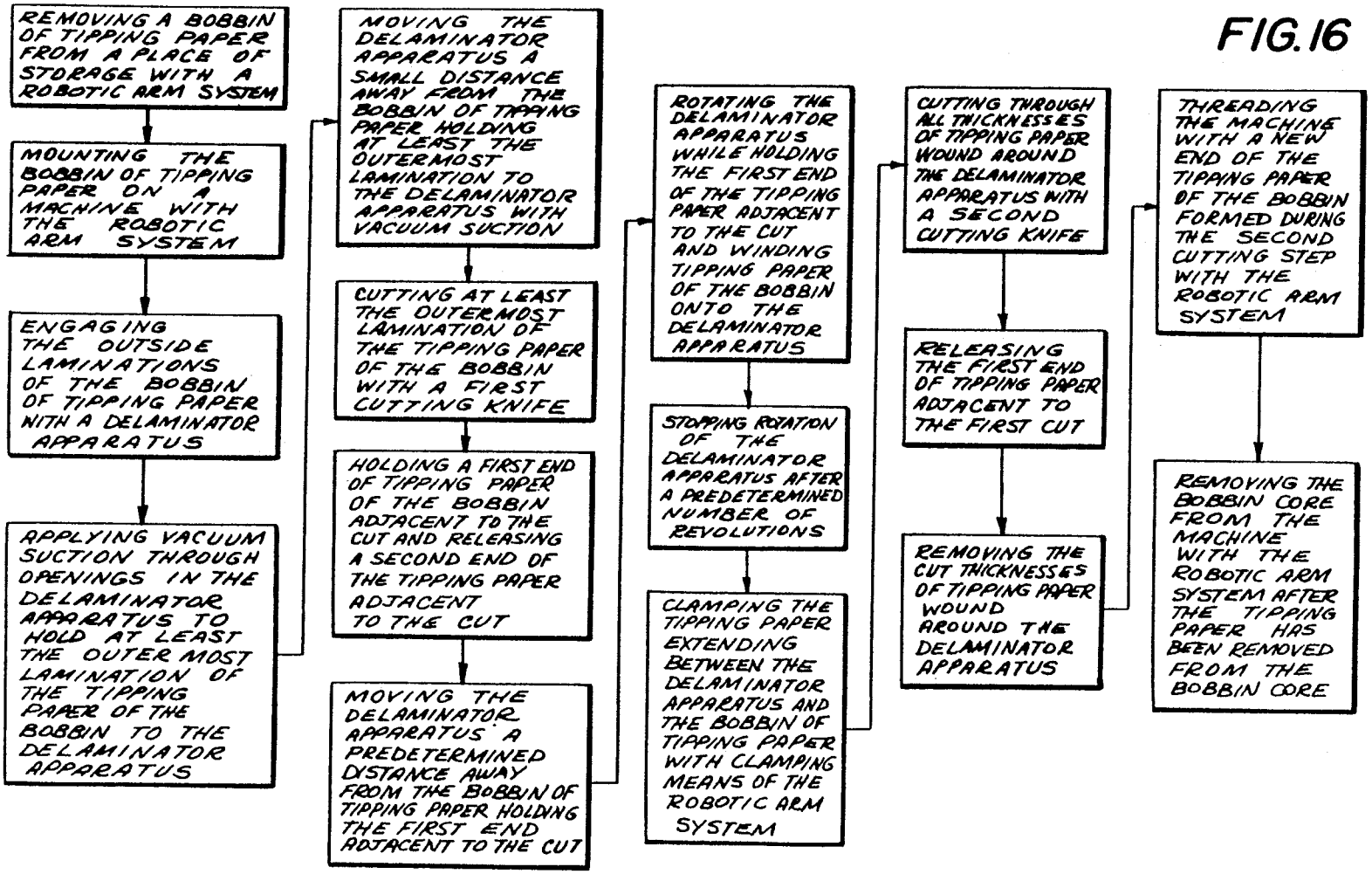
FIG. 16 is a block diagram of the preferred method of the system of the invention.
Figure 17:
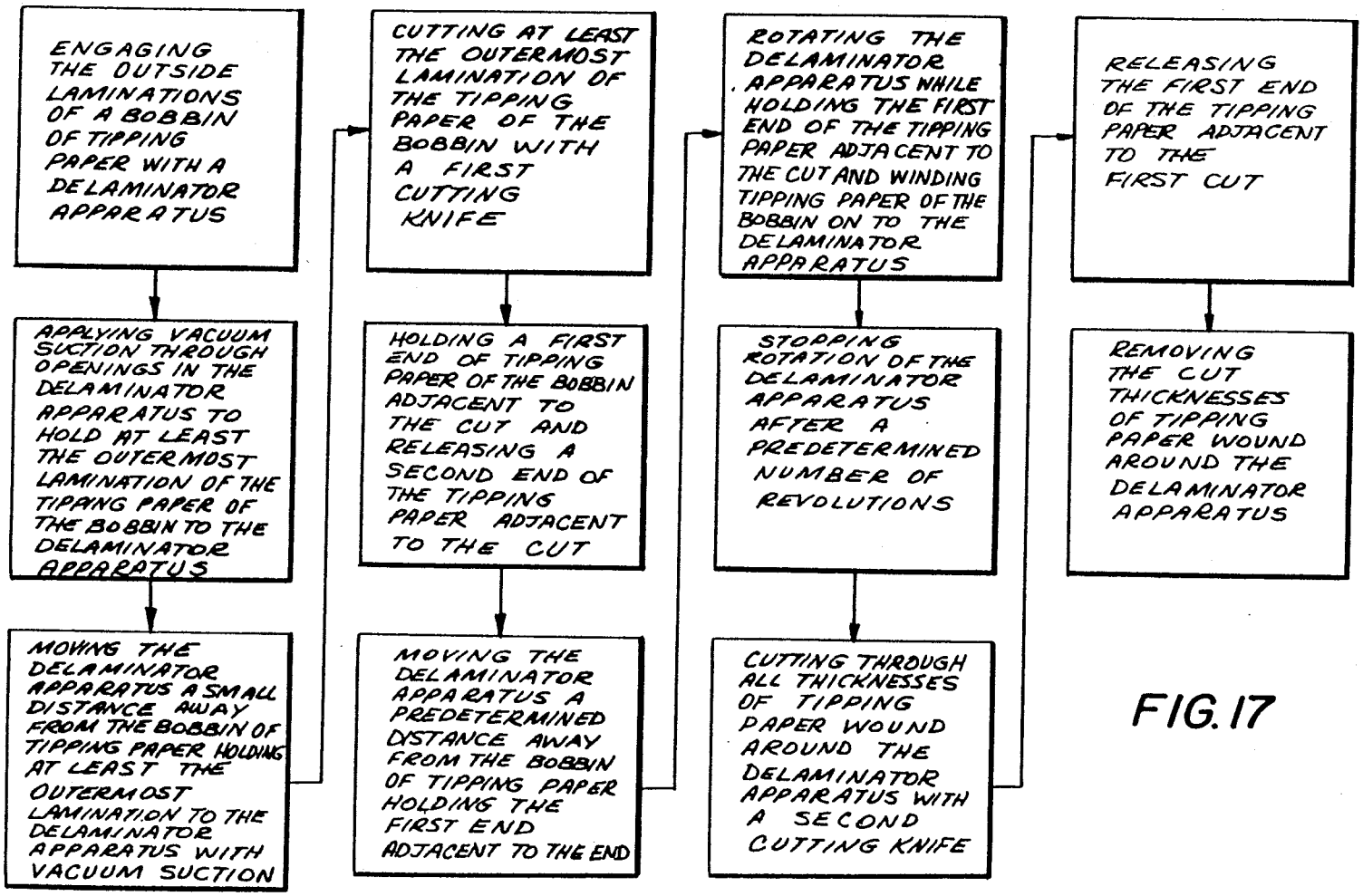
FIG. 17 is a block diagram of the preferred method of the invention as carried out by the delaminator apparatus of the invention.

Referring to FIGS. 16 and 17, the embodiments of the method of the invention will be described. The preferred method of the system of the invention is shown in block form in FIG. 16. In describing the preferred method of the system of the invention, reference will be made to the system as shown in FIG. 1, and as shown in the fragmented side view in FIG. 15. Reference will be made to other figures as indicated when required.

When it is desired to remove new bobbin 170 from its place of storage after the height, Z, and the position the bobbin cores are determined, control console 212 is activated as necessary to guide robotic arm 182 having robotic hand 185 disposed at its distal end to a place where undelaminated bobbins of tipping paper 170 are stacked ready for processing by machine 101. During movement of robotic arm 182 and robotic hand 185 to the place of storage of the bobbins of tipping paper 170, robotic hand 185 is caused to rotate with respect to the distal end of robotic arm 182 at rotatable coupling 184. Robotic hand 185 is rotated such that bobbin core-engaging device 196 at the end of section 186 of robotic hand 185 is directed downwardly. This position is 90° from the position of section 186 of robotic hand 185 shown in FIGS. 1 and 10. Once robotic hand 185 has bobbin core-engaging device 196 directed downwardly, robotic arm 182 is guided so that bobbin core-engaging device 196 is inserted in in bobbin core 172. After inserting bobbin core-engaging device 196 into the opening in bobbin core 172, control console 212 is activated to provide air under pressure to double acting fluid cylinder 404 to cause push rod 806 to reciprocate toward the distal end of bobbin core-engaging device 804. The reciprocation of push rod 804 in the above described direction in turn causes force transmission member 902 to reciprocate in the same direction. As force transmission member 902 reciprocates toward the distal end of bobbin core-engaging device 196, the plurality of bobbin core-engagement member 800 are driven further radially outward until they engage the interior surface of bobbin core 172. Once all of bobbin core engagement members 800 contact the interior surface of bobbin core 172, bobbin of tipping paper 170 is held fast to bobbin core-engaging device 196 for removal from the place of storage and handling of the bobbin.

Following the removal step, the new undelaminated bobbin of tipping paper is mounted on machine 101. To mount the new bobbin of tipping paper 170 on machine 100, control console 212 is activated and directs movement of robotic arm 182 with robotic hand 185 having new bobbin 170 held fast thereto to move the bobbin from the place of storage to a position for transferring the bobbin from robotic hand 185 to machine 101. During the movement of robotic arm 182, robotic hand 186, and bobbin 170 held fast to robotic hand 182, control console 212 is activated to cause robotic hand 185 to index 90° so that section 186 of robotic hand 185 is pointed toward machine 101, as shown in FIG. 1. Robotic arm 182 with robotic hand 185 having a new bobbin of tipping paper 170 held fast thereto is moved to a position in which the distal end of bobbin core-engaging device 196 is aligned with and adjacent to idle spindle 174 of machine 101. After this alignment, control console 212 is activated to cause air pressure to be input to double acting fluid cylinder 806 to cause push rod 806 to reciprocate into double acting fluid cylinder 804. This releases engagement member 800 from their holding relationship with the interior surface of bobbin core 172. As the engagement members release the bobbin, control console 212 is activated to cause air under pressure to be input to double acting fluid cylinder 190 to cause push rod 197, shown in phantom in FIG. 8, to reciprocate toward the distal end of bobbin core-engaging device 196. This reciprocation of push rod 197 in turn causes push plate 195 connected to the distal end of push rod 197 to reciprocate in the same direction thereby engaging bobbin of tipping paper 170 and pushing it from bobbin core-engaging device 196 onto idle spindle 174. Proper seating of the new bobbin of tipping paper 170 against a machine flange (not shown) disposed about idle spindle 174 is determined by the plurality of pressure sensitive pads 802 disposed on the side of push plate 195 that contacts to bobbin 170. This proper seating on idle spindle 174 and against machine flange associated with idle spindle 174 is ensured by the push plate 195 driving the bobbin up against the machine flange and pads 802 biasing outwardly to correct for the possible nonparallel disposition of push plate 195 with respect to the machine flange. After the bobbin is placed properly on idle spindle 174 and against the machine flange, control console 212, control console 212 causes air under pressure to be input to double acting fluid cylinder 190 to reciprocate push plate 195 in an opposite direction to its original position disposed about bobbin core-engaging device 196, as shown in FIG. 10.

Also following the mounting step, the outermost lamination of the tipping paper of the bobbin of tipping paper 170 is engaged by elongated member 102 of delaminator apparatus 100, as shown in FIG. 15. For elongated member 102 to engage the bobbin of tipping paper 170, as shown in FIG. 15, control console 212 is activated to cause activation of positioning motor 160 via control lines 216 and 220. Activation of positioning motor 160 causes threaded shaft 132 to turn in the appropriate direction to move assembly 105, of which elongated member 102 is a part, along rods 128 and 152 toward bobbin 170.

Once the engaging step for engaging the outermost lamination of bobbin of tipping paper 170 with elongated member 102 apparatus is complete, vacuum suction is applied through general vacuum channels 522 and 520 which in turn supply the vacuum suction to longitudinal openings 436 and 502 in vacuum suction directing inserts 434 and 500, respectively, via respective vacuum suction orifices 508 and 504. The vacuum suction through respective longitudinal openings 436 and 502 suck at least the outermost lamination of tipping paper of the bobbin in contact with the sloping top surfaces of the respective vacuum suction directing inserts 434 and 500, thereby disposing that lamination of tipping paper across groove 430.

After the step for applying of vacuum suction, elongated member 102 is moved a small distance from bobbin of tipping paper 170 holding at least the outermost lamination of tipping paper to the top surfaces of vacuum suction directing inserts 434 and 500, and across groove 430. The distance that elongated member 102 moves away from the bobbin is preferably in the range of 0.030 to 0.090 inches.

Subsequent to the moving step, at least the outermost lamination of the tipping paper held to the top surfaces of vacuum suction directing inserts 434 and 500, and across the groove 430 is cut by first cutting knife 420. In carrying out this first cutting step, control console 212 is activated to cause air under pressure to be input to double acting fluid cylinder 116. This causes the push rod assembly comprising push rod 406, coupling 408 and knife pushrod 410, spacers 412 and 414, bearing 416 and retaining ring 418 to reciprocate in a direction toward the distal end of elongated member 102 (FIG. 4). As the push rod assembly reciprocates in the above described direction, both first cutting knife 420 and second cutting knife 420 reciprocate in grooves 430 and 432, respectively, since both knives are rotatably connected the push rod assembly by pins 422 and 424, respectively In the reciprocation of the first cutting knife 420, surface 510 of knife 430 contacts edge 506 of vacuum suction directing insert 434 to shear the tipping paper disposed across groove 430.

After the first cutting step, a first end of the tipping paper adjacent to the cut is held to the top of vacuum suction insert 500, while a second end of the tipping paper adjacent to the cut previously held to the top surface of vacuum suction directing insert 434 is released. This step is carried out by proper activation of control console 212 to direct that vacuum suction be cut off to general vacuum channel 522 thereby cutting off vacuum suction to vacuum suction orifices 508 and longitudinal opening 436 of vacuum suction directing insert 434. Once the vacuum suction is cut off, the second end of the tipping paper adjacent to the cut falls free of elongated member 102.

Following the holding and releasing step, elongated member 102 is moved a predetermined distance away from the bobbin of tipping paper 170 holding the first end of the tipping paper adjacent to the first cut to the top surface of vacuum suction directing insert 500 by vacuum suction. Elongated member 102, as shown in FIG. 15, moves from its position adjacent bobbin 170 to a second position outward from the bobbin in a horizontal direction The elongated member 102 is moved to the second position by activation of control console 212 to cause activation of positioning motor 160. Activation of positioning motor 160 causes threaded shaft 132 to turn in the appropriate direction causing assembly 105 to move along rods 128 and 152 away from the bobbin of tipping paper.

Simultaneous with this moving step, elongated member 102 is rotated a predetermined number of revolutions while holding the first end of the tipping paper adjacent to the first cut to the top surface of vacuum suction directing insert 500 to wind the possibly damaged outer laminations of tipping paper onto elongated member 102. In carrying out this step, control console 212 is activated to cause activation of rotation motor 148 via lines 216 and 218. Activation of rotation motor 148 causes shaft 330, coupling 328, drive shaft 324 and drive gear 270 to turn. Since drive gear 270 is meshed with driven gear 112 fixed to elongated member 102, as drive gear 270 rotates driven gear 112 and elongated member 102 rotate. As elongated member 102 rotates in a clockwise direction, laminations of tipping paper of the bobbin of tipping paper are wound around elongated member 102. When elongated member 102 rotates as described, it causes the bobbin of tipping paper 170 to rotate in a counterclockwise direction.

Following the completion of the rotating and winding step, rotation of the elongated member 102 is stopped. The rotation of elongated member 102 is stopped by control console 212 being activated to deactivate rotation motor 148.

Subsequent to the stopping step, control console 212 is activated to move robotic arm 182 and robotic hand 185 so that the tipping paper extending between the bobbin of tipping paper 170 and elongated 102 is clamped between first finger 208 and second finger 206. In order to clamp the tipping paper between first finger 208 and second finger 206, control console 212 causes air under pressure to first be directed to double acting air cylinder 210 to cause push rod 814 to reciprocate in a direction toward cylinder 210. As push rod 814 reciprocates toward cylinder 210, second finger 206 oscillates about pivot point 816 opening a gap between cushioned surfaces 810 and 812 of first finger 208 and second finger 206, respectively. After the gap is formed, robotic hand 185 is moved toward machine 101 until the tipping paper is disposed between first finger 208 and second finger 206. When the tipping paper is disposed in the gap between first finger 208 and second finger 206, control console 212 is activated causing air under pressure to be input to double acting cylinder 210 to cause push rod 814 to reciprocate in a direction away from cylinder 816, thereby oscillating second finger 206 about pivot point 816 and clamping the tipping paper between the cushioned surfaces of the first and second fingers.

Subsequent to the clamping step, the thicknesses of possibly damaged tipping paper wound around elongated member 102 are cut with second cutting knife 428. In carrying out the second cutting step, control console 212 is activated causing air under pressure to be input to double acting fluid cylinder 116 to cause the push rod assembly connected thereto to reciprocate in a direction away from the distal end of elongated member 102. In the reciprocation of the push rod assembly in this direction, both cutting knives are reciprocated in their respective grooves in the same direction as the push rod assembly since each is rotatably connected to the push rod assembly, as described. As second cutting knife 428 is reciprocated in the above indicated direction, blade 104 cuts through the thicknesses of tipping paper wound around the elongated member 102. Once blade 104 of second cutting knife 428 cuts through the thicknesses of tipping paper wound around the elongated member, a new end of the tipping paper of the bobbin of tipping paper 170 is formed and falls free of elongated member 102 but remains clamped between first finger 208 and second finger 206.

Following the second cutting step, the first end of the tipping paper adjacent to the first cut previously held to the top surface of vacuum suction directing insert 500 is released by cutting off vacuum suction to that vacuum suction directing insert. This is accomplished by control console 212 being activated so that vacuum suction is cut off to general vacuum channel 520, which in turn cuts off vacuum suction to the set vacuum suction orifices 504 and longitudinal opening 502.

After the releasing step, the cut thicknesses of possibly damaged tipping paper are removed from elongated member 102. The cut thicknesses are removed from elongated number 102 by activating control console 212 to cause a reversal of the vacuum suction generating devices (not shown) to provide positive air pressure to general vacuum channels 520 and 522 which in turn provide the positive air pressure to vacuum suction orifices 504 and 508, and longitudinal openings 502 and 436, respectively. This positive air pressure blows the cut thicknesses of possibly damaged tipping paper from elongated member 102. Once the cut thicknesses are blown from elongated member 102, the positive air pressure is stopped.

Simultaneous with the removing step for removing the cut thicknesses of possibly damaged tipping paper from elongated member 102, robotic arm 182 having robotic hand 185 holding the new end of the tipping paper of the bobbin clamped between first finger 208 and second finger 206 is indexed, as shown in phantom in FIG. 15, to thread machine 101 with undamaged tipping paper of the bobbin. As shown in FIG. 1, robotic hand 185 is moved or indexed such that, for example, the tipping paper is threaded over rollers 176, 178 and 180. It is obvious to one skilled in the art that the remainder of the stations (not shown) of machine 101 can be threaded with tipping paper in the same manner so that the tipping paper can be processed by machine 101.

Once the threading step is completed, the tipping is processed in accordance with the processing function of machine 101.

During the processing step, robotic arm 182 and robotic hand 185 are indexed in the previously described manner to the place of storage of undelaminated bobbins of tipping paper. Once there, robotic arm 182 and robotic hand 185 are guided so robotic hand 185 engages the next bobbin of tipping paper in the above described manner for delamination and processing.

Following processing, all of the tipping paper is removed from the bobbin core thereby leaving an empty bobbin core on machine 101 which must be removed before a new bobbin can be mounted on the machine. In carrying out the step of removing bobbin core 172, control console 212 is activated to move robotic arm 182 and robotic hand 185 toward machine 101. In this movement, first finger 208 is oriented so that it is in a horizontal plane. As robotic hand 185 is moved toward machine 101, control console 212 is also activated to cause air under pressure to be directed to double acting fluid cylinder 204. The air input to cylinder 204 causes push rod 806 to reciprocate in a direction away from the distal end of section 198 to cause third finger 200 to oscillate about pivot point 808 to open a greater gap between it and a second side first finger 208 not having cushioned material 810 disposed thereon. Once the gap between first finger 208 and third finger 200 is greater than the outside diameter of bobbin core 172, the robotic arm 182 is caused to move toward machine 101 such that first finger 208 is disposed below and third finger 200 is disposed above bobbin core 172 on idle spindle 174. After first finger 208 and third finger 208 are so positioned, control console 212 is activated to cause air under pressure to be input to double acting cylinder 204 to cause push rod 806 to reciprocate in an opposite direction. This causes third finger 200 to oscillate in an opposite direction about pivot point 808 so the first finger 208 and third finger 200 engage bobbin core 172. After bobbin core 172 is so engaged, control console 212 is activated to cause robotic arm 182 and robotic hand 185 to move away from machine 101. As robotic hand 182 moves away from machine 101, it removes bobbin core 172 from idle spindle 174 of machine 101. The robotic hand having the next bobbin of undelaminated tipping paper attached thereto is indexed so that the distal end of bobbin core engaging device 196 is aligned with and adjacent to idle spindle 174 of machine 101. The new bobbin is then mounted on the idle spindle in the previously described manner. Following removal of bobbin core 172, the bobbin core is held by the first and second finger until disgarded following the threading step when robotic arm 182 and robotic hand 185 are indexed to remove the next undelaminated bobbin of tipping paper from the place of storage.

The above described preferred method of the system of the invention was described for semi-automatic operation of the system. However, the operation of the system of the invention in accordance with the above described method can be fully automatic not requiring intervention by an operator.

In a second embodiment of the method of the system of the invention, the second embodiment of the elongated member of the invention, as shown in FIG. 7, is used. The second embodiment of the elongated member is similar to the preferred embodiment of the elongated member except first cutting knife 630 is different from cutting knife 420 and first groove 614 is not stepped but is a rectangular groove. Also, instead of having vacuum suction directing inserts disposed on the steps of the groove, longitudinal openings 608 and 616 are defined in the elongated member adjacent to the top edges of the groove.

In the second embodiment of the method of the system of the invention in which the second embodiment of the elongated member is used, the steps of the method as set forth in the preferred embodiment of the method are the same except for the first cutting step. In the first cutting step in the second embodiment of the method of the invention, when first cutting knife 630 is reciprocated in groove 614 to cut the tipping paper disposed across the groove, cutting edge 638 of blade 636 cuts the tipping paper and the paper is not sheared as set forth in the preferred embodiment of the method of the system of the invention. Except for this change, the preferred and second embodiments of the method of the system of this invention are substantially the same.

In the third embodiment of the method of the system of the invention, the third embodiment of the elongated member as shown in FIG. 9, is used. The third embodiment of the elongated member is similar to the preferred embodiment of the elongated member shown in FIG. 6 except for the differences described for the second embodiment of the elongated member, plus the addition of blade support structure 716 having pad 720 disposed on its top surface, which changes the manner in which the first end of the tipping paper adjacent to the first cut is held prior to and during the rotation and winding step.

In the third embodiment of the method of the system of the invention using the third embodiment of the elongated member shown in FIG. 9, first cutting knife 720 is substantially the same as first cutting knife 630 of the second embodiment of the elongated member and cuts the tipping paper disposed across groove 714 in substantially the same manner. However, in the third embodiment of the method of the system of the invention, when knife 720 is reciprocated in groove 714 to cut the tipping paper across the groove, the first end of tipping paper adjacent to the cut is held between the bottom surface of the blade of cutting knife 720 and the top surface of pad 718 disposed on the top surface of blade support structure 716. Once the tipping paper is held between the blade of cutting knife 720 and pad 718, vacuum suction is cut off to general vacuum channels 712 and 726. The subsequent steps are similar to those in the preferred embodiment of the method of the system of the invention except that the first end of the tipping paper adjacent to the cut is held to elongated member 700 by the cooperative action of the blade of knife 720 and pad 718. Therefore, except for this different manner of cutting the tipping paper disposed across groove 714 and holding the first end of tipping paper adjacent to the first cut, the third embodiment of the method of the system of the invention is substantially the same as the preferred embodiment of the method of the system of the invention.

Referring to FIG. 17, the method of operation of the delaminator apparatus will be described for use in the system of the invention. In describing the method of the embodiments of the delaminator apparatus of the invention reference is made to FIGS. 1, 2, 3, 4, 5 and 15. Other figures needed to describe the method of the embodiments of the delaminator apparatus will be indicated when necessary.

When an undelaminated bobbin of tipping paper is mounted on machine 101, it must have any possibly damaged outer laminations of tipping paper removed prior to processing the tipping paper with machine 101. In accordance with the preferred method of the preferred embodiment of delaminator apparatus 100, the outermost lamination of tipping paper on the bobbin 170 is engaged by elongated member 102. For elongated member 102 to engage the bobbin of tipping paper 170, as shown in FIG. 15, the delaminator assembly 105 is driven by positioning motor 160 and threaded shaft 132 toward bobbin of tipping paper 170 mounted on machines 101 so that top surfaces 206 and 214 of vacuum suction directing inserts 434 and 500 contact the outermost lamination of tipping paper of the bobbin.

Once the engaging step for engaging the outermost lamination of the bobbin of tipping paper with the delaminator apparatus is complete, vacuum suction is applied through general vacuum suction channels 520 and 522 which in turn supply the vacuum suction to longitudinal openings 502 and 436 in vacuum suction directing inserts 500 and 434, respectively, via respective vacuum suction orifices 504 and 508. The vacuum suction applied through respective longitudinal openings 436 and 502 suck at least the outer most lamination of tipping paper of the bobbin in contact with the sloping top surfaces of the respective vacuum suction directing inserts 434 and 500, thereby, disposing at least that lamination of tipping paper across groove 430.

After the step for applying vacuum suction, elongated member 102 is moved a small distance from the bobbin of tipping paper 170 holding at least the outermost lamination of tipping paper to the top surfaces of vacuum suction directing inserts 434 and 500 across stepped groove 430. The distance that elongated member 102 moves away from the bobbin is, preferably, in the range of 0.030 to 0.090 inches.

Subsequent to the moving step, at least the outermost lamination of the tipping paper held to the top surfaces of vacuum suction directing inserts 434 and 500 across the groove 430 is cut by first cutting knife 420. In carrying out this first cutting step, control console 212 is activated to cause air under pressure to be input to double acting fluid cylinder 116 to cause the push rod assembly to reciprocate in a direction toward the distal end of elongated member 102 (FIG. 4). As the push rod assembly reciprocates in the above described direction, first cutting knife 420 and second cutting knife 428 reciprocate in grooves 430 and 432, respectively, since the knives are rotatably connected to the push rod assembly by pins 422 and 424, respectively. In the reciprocation of first cutting knife 420, surface 510 of knife 420 contacts edge 506 of vacuum suction directing insert 434 to shear the tipping paper disposed across groove 430.

Subsequent to the first cutting step, a first end of the tipping paper adjacent to the cut is held to the top of vacuum suction insert 500, while a second end of the tipping paper adjacent to the cut previously held to the top surface of vacuum suction directing insert 434 is released. This step is carried out by proper activation of control console 212 to direct that vacuum suction to be cut off to general vacuum channel 522, thereby, cutting off vacuum suction to vacuum suction orifices 508 and longitudinal opening 436 of vacuum suction directing insert 434. Once the vacuum suction is cut off, the second end of the tipping paper adjacent to the cut falls free of elongated member 102.

Following the holding and releasing step, delaminator assembly 105 is moved a predetermined distance away from the bobbin of tipping paper 170 holding the first end of the tipping paper adjacent to the first cut to the top surface of vacuum suction directing insert 500 by vacuum suction. Elongated member 102 moves from its position adjacent bobbin 170 to a second position. Elongated member 102 is moved to the second position by activation of control console 212 which causes activation of positioning motor 160 via control lines 216 and 220. Activation of positioning motor 160 causes threaded shaft 132 to turn in the appropriate direction to move delaminator assembly 105, of which elongated member 102 is a part, to move along rods 128 and 152.

Simultaneous with this moving step, elongated member 102 is rotated a predetermined number of revolutions in the clockwise direction while holding the first end of the tipping paper adjacent to the first cut to the top surface of vacuum suction directing insert 500 to wind the possibly damaged outer laminations of tipping paper of the bobbin onto elongated member 102. To carry out rotation of elongated member 102, control console 212 is activated to cause activation of rotation motor 148 via control lines 216 and 218. Activation of rotation motor 148 causes rotation of drive gear 270 connected to rotation motor 148 through drive shaft 330, coupling 328 and drive gear shaft 324. As drive gear 270 rotates, it causes meshed driven gear 112 to rotation. Since driven gear 112 is connected to elongaged member 102, it will also rotate. As elongated member 102 is rotated in a clockwise direction, laminations of tipping paper of the bobbin are wound onto elongated member 102.

Following the completion of the rotating and winding step, rotation of the elongated member 102 is stopped. The rotation of elongated member 102 is stopped by control console 212 being activated to deactivate stepper motor 148 thereby stopping rotation of drive gear 270, driven gear 112 and elongated member 102.

Subsequent to the stopping step, the thicknesses of possibly damaged tipping paper wound onto elongated member 102 are cut with second cutting knife 428. In carrying out the second cutting step, control console 212 is activated causing air under pressure to be input to double acting fluid cylinder 116. This will mean that the push rod assembly connected to cylinder 116 will reciprocate in a direction away from the distal end of elongated member 102. In the reciprocation of the push rod assembly in this direction, both cutting knives are reciprocated in their respective grooves in the same direction as the push rod assembly, since each is rotatably connected to the push rod assembly via pins 422 and 424, respectively. As second cutting knife 428 is reciprocated in the above indicated direction, blade 104 cuts through the thicknesses of tipping paper wound around elongated member 102. Once second cutting knife 428 cuts through the thicknesses of tipping paper wound around the elongated member, a new end of the tipping paper of the bobbin of tipping paper 170 is formed and falls free of elongated member 102.

Following the second cutting step, the first end of the tipping paper adjacent to the first cut previously held to the top surface of vacuum suction directing insert 500 is released by cutting off vacuum suction to that vacuum suction directing insert 500. This is accomplished by control console 212 being activated so that vacuum suction is cut off to general vacuum channel 520 which in turn cuts off vacuum suction to the vacuum suction orifices 504 and longitudinal opening 502 of vacuum suction directing insert 500.

After the releasing step, the cut thicknesses of possibly damaged tipping paper are removed from elongated member 102. The cut thicknesses are removed from the elongated member by activating control console 212 to cause a reversal of the vacuum suction generating devices (not shown) to provide positive air pressure to general vacuum channels 520 and 522 which in turn provide positive air pressure to vacuum suction orifices 504 and 508 and longitudinal openings 502 and 436, respectively. This positive air pressure blows the cut thicknesses of possibly damaged tipping paper from elongated member 102. Once the cut thicknesses are blown from elongated member 102, the positive air pressure is stopped.

After removal of the cut thicknesses of possibly damaged tipping paper from elongated member 102, the elongated member is ready to delaminate the next bobbin of tipping paper 170 when required.

The above described method of operation of elongated member 102 was described for semi-automatic operation of the delaminator apparatus. However, the operation of the delaminator apparatus of the invention can be fully automatic not requiring intervention by an operator.

In a second embodiment of the method of the delaminator apparatus of the invention, the second embodiment of the elongated member of the invention, as shown in FIG. 7, is used. The second embodiment of the elongated member is similar to the preferred embodiment of elongated member except cutting knife 630 is different from cutting knife 420, and first groove 614 is not stepped but is a rectangular groove. Also, instead of having vacuum suction directing inserts disposed on the steps of the groove, longitudinal openings 608 and 616 are defined in the elongated member adjacent to the top edges of the groove.

In the second embodiment of the method of the delaminator apparatus of the invention in which the second embodiment of the elongated member is used, the steps of the method as set forth in the preferred embodiment of the method are the same except for the first cutting step. In the first cutting step in the second embodiment of the method of the delaminator apparatus of the invention, when first cutting knife 630 is reciprocated in groove 614 to cut the tipping paper disposed across the groove, cutting edge 638 of blade 636 cuts the tipping paper disposed across groove 614 and the tipping paper is not sheared as set forth in the preferred embodiment of the method of delaminator apparatus. Except for this change, the preferred and second embodiments of the method of the delaminator apparatus are substantially the same.

In the third embodiment of the method of delaminator apparatus of the invention, the third embodiment of the elongated member, as shown in FIG. 9, is used. The third embodiment of the elongated member is similar to the preferred embodiment of the elongated member shown in FIG. 6 except for the differences described for the second embodiment of the elongated member plus the addition of blade support structure 716 having pad 718 disposed on its top surface, which changes the manner in which the first end of the tipping paper adjacent to the first cut is held prior to and during the rotation and winding step.

In the third embodiment of method of the delaminator apparatus of the invention using the third embodiment of elongated member shown in FIG. 9, first cutting knife 720 is substantially the same as first cutting knife 630 of the second embodiment of the elongated member and cuts the tipping paper disposed across groove 714 in substantially the same manner. However, in the third embodiment of the method of the delaminator apparatus when knife 720 is reciprocated in groove 714 to cut the tipping paper across groove 714, the first end of tipping paper adjacent to the cut is held between the bottom surface of the blade of cutting knife 720 and the top surface of pad 718 disposed on the top surface of blade support structure 716. Once the tipping paper is held between the blade of cutting knife 720 and pad 718, vacuum suction is cut off to both general vacuum channels 712 and 726. The subsequent steps are similar to those in the preferred embodiment of the method of the delaminator except that the first end of the tipping paper being held to elongated member by vacuum suction through longitudinal opening 502 is now held to the elongated member by the cooperative action of the blade of knife 720 and pad 718. Therefore, except for the different manner of cutting the tipping paper disposed across groove 714 and holding the first end of tipping paper adjacent to the first cut, the third embodiment of the method of the delaminator apparatus of the invention is substantially the same as the preferred embodiment of the method of the delaminator apparatus of the invention.

The terms and expressions which are employed here are used as terms of description and not of limitation, and there is no intention, in the use of such terms and expressions, of excluding any equivalents of the features shown and described, or portions thereof, it being recognized that various modifications are possible within the scope of the invention as claimed.

We claim:

1. A robotic hand for connection to and use with a robotic arm assembly comprising:

a bobbin core-engaging means for inserting into a bobbin core of a bobbin of paper material or the like for holding said bobbin of paper material fast to said bobbin core-engaging means;

a bobbin transfer means for transferring said bobbin of paper material held fast to bobbin core-engaging means from said bobbin core engaging means;

clamping means for clamping at least one lamination thickness of paper material from the bobbin of material therebetween; and bobbin core removal means for removing a bobbin core from a processing machine used to process said bobbin of paper material after the paper material of the bobbin has been removed therefrom.

2. A robotic hand as recited in claim 1, wherein the bobbin core-engaging means is disposed at a distal end of a first section of said robotic hand and further comprises a tubular housing having a diameter less than an inside diameter of said bobbin core, a plurality of engagement members extending radially outward from the interior of said tubular housing through the wall of said tubular housing, and a first drive means with means contacting said plurality of engagement members for driving said plurality of engagement means farther radially outward from said tubular housing to engage an interior surface of said bobbin core for purposes of lifting and handling said bobbin of material with said robotic arm to which said robotic hand is rotatably fixed.

3. A robotic hand as recited in claim 1, wherein said bobbin transfer means is connected to a first section of said robotic hand and is disposed about said bobbin core-engaging means and said bobbin transfer means further comprises a plate having at least one guide rod attached to a first side, guide rod support means connected to said first arm for supporting at least one guide rod, second drive means connected to said plate for reciprocating said plate in a first and second direction for transferring said bobbin of paper material from said bobbin core-engaging means, and pressure sensitive means disposed in a second side of said plate for biasing the bobbin of paper material away from said second side of said plate of the bobbin transfer means for properly seating said bobbin of paper material on said machine at transfer of the bobbin of paper material from the bobbin core-engaging means to said machine.

4. A robotic hand as recited in claim 3, wherein a first switch means is connected to said first section of said robotic hand and an intermediate member is disposed in and extends from said first side of said plate of the bobbin transfer means whereby when said plate is in a retracted position disposed about the bobbin core-engaging means said intermediate member contacts said first switch means.

5. A robotic hand as recited in claim 4, wherein the first switch means is closed when said intermediate member contacts said first switch means and said pressure sensitive means is depressed into said plate and contacts said intermediate means indicating said bobbin core-engaging means is disposed within the bobbin core of the bobbin of paper material a side of and said plate is against the side of said bobbin of paper material.

6. A robotic hand as recited in claim 3, wherein a second switch means is disposed near the end of said guide rod support means farthest from the distal end of the first section and a switch activator means is disposed at the distal end of at least one guide end in alignment with said second switch for closing said second switch means when said plate of said bobbin transfer means is reciprocated to its fullest extension from said distal end of said first section and said switch actuator means contacts second switch means.

7. A robotic hand as recited in claim 6, wherein said second switch means is opened after being closed when said plate of said bobbin transfer means contacts an object with sufficient force that said plate is caused to move toward the distal end of said first section thereby breaking contact between said switch actuator means and the second switch means.

8. A robotic hand as recited in claim 1, wherein said clamping means is disposed at a distal end of a second section of said robotic hand and further comprises a fixed plate member means connected to said second section, a movable plate member means pivotably connected to said second section and a third drive means connected to said movable plate member means and said second section for oscillating said movable plate member means toward or away from said fixed plate member means.

9. A robotic hand as recited in claim 1, wherein bobbin core removal means is disposed adjacent to said clamping means at a distal end of a second section of said robotic hand and further comprises a fixed member means connected to said second section, a movable bracket member means pivotably connected to said second section and a fourth drive means connected to said movable bracket member means and said second section for oscillating said movable bracket member means toward and away from said fixed member means.

10. A robotic hand as recited in claim 1, wherein said bobbin core-engaging means further comprises a tubular housing having an outside diameter less than the inside diameter of said bobbin core, a plurality of engagement members spaced away from a distal end of said housing and extending from the interior of said tubular housing through respective openings in the wall of said housing to the exterior of said housing and extending radially outward therefrom, each of said plurality of engagement members being generally rectangular in shape and having a substantially flat first end disposed outside said housing and a substantially rounded second end disposed within said housing, said rounded ends of the plurality of engagement members being disposed near the longitudinal centerline of said housing, force transmission means longitudinally disposed within said housing, said force transmission means communicating between said plurality of engagement means and a first drive means, repositioning means disposed about a portion of said force transmission means for repositioning said housing such that an interior surface of said bobbin core and said exterior surface of said housing are substantially concentric.

11. A robotic hand as recited in claim 10, wherein said force transmission means is a continuous rod with a first section having a first diameter and said first section is disposed from a first end of said rod with said first end having a spherical opening defined therein for receiving a portion of said first drive means, a second tapered section tapering from said first diameter to a second diameter with said second diameter being smaller than said first diameter, a third elongated section having said second diameter, a fourth tapered section tapering from said second diameter to a third diameter with said third diameter being greater than said second diameter, a fifth section having said third diameter, a sixth tapered section at a second end of said rod tapering from said third diameter of said fifth section to a substantial point with at least a portion of said taper of said sixth section contacting said rounded second ends of said plurality of engagement members.

12. A robotic hand as recited in claim 11, wherein said repositioning means is disposed about said third section of said rod and further comprises a circular plate member having an outside diameter slightly less than an inside diameter of said housing, a central bore of a diameter greater than the diameter of said third section of said rod and second drive means with means connected to said circular plate member for reciprocating said circular plate member from a first position against said tapered second section to a second position against said tapered fourth section with said circular plate member being a pivoting means for said force transmission means when in said first position.

13. A robotic hand as recited in claim 1, wherein said bobbin core-engaging means further comprises a tubular housing having an outside diameter less than the inside diameter of said bobbin core, a plurality of engagement members spaced away from a distal end of said housing and extending from the interior of said tubular housing through respective openings in the wall of said housing to exterior of said housing and extending radially outward therefrom, each of said plurality of engagement members being generally rectangular in shape and having a substantially flat first end disposed outside said housing and a substantially rounded second end disposed within said housing, said rounded ends of the plurality of engagement members being disposed near a longitudinal centerline of said housing, force transmission means longitudinally disposed in said housing, said force transmission means communicating between said plurality of engagement members and a first drive means.

14. A robotic hand as recited in claim 13, wherein said force transmission means is a continuous rod with a elongated first section having a first diameter and said first section is disposed from a first end said rod with said first end having a spherical opening defined therein for receiving a portion of said first drive means, an annular flange spaced away from said first end and fixed to said first section of said rod with said flange having an outside diameter slightly less than an inside diameter of said housing and being a pivoting means for said rod, and a second tapered section at a second end of said rod tapering from said first diameter to a point with a portion of said taper of said second section contacting said rounded ends of said plurality of engagement members.

* * * * *

UNITED STATES PATENT AND TRADEMARK OFFICE

CERTIFICATE OF CORRECTION

PATENT NO. : 4,934,624

DATED : June 19, 1990

INVENTOR(S) : Grollimund et al.

It is certified that error appears in the above-identified patent and that said Letters Patent is hereby corrected as shown below:

Column 4, line 4, change "in" to --is--.

Column 4, line 12, after "machine" insert a period --.--.

Column 12, line 49, after "springs" insert a period --.--.

Column 12, line 59, delete "is".

Column 13, line 16, delete "is".

Column 13, line 43, after "described" insert a period --.--.

Column 13, line 49, change "undeliminated" to --undelaminated--.

Column 13, line 52, change "stock" to --stack--.

Column 16, line 21, after "housing" insert a period --.--.

Column 18, line 10, delete "in" (first occurrence).

UNITED STATES PATENT AND TRADEMARK OFFICE

CERTIFICATE OF CORRECTION

PATENT NO. : 4,934,624

DATED : June 19, 1990

INVENTOR(S) : Grollimund et al.

It is certified that error appears in the above-identified patent and that said Letters Patent is hereby corrected as shown below:

Column 19, line 61, after "spectively" insert a period --.--.

Column 20, line 18, after "direction" insert a period --.--.

Column 21, line 41, change "number" to --member--.

Signed and Sealed this

Nineteenth Day of October, 1993

*Attest:*

*Attesting Officer*

BRUCE LEHMAN

*Commissioner of Patents and Trademarks*